US011686513B2

(12) United States Patent
Subrahmanya et al.

(10) Patent No.: US 11,686,513 B2
(45) Date of Patent: Jun. 27, 2023

(54) FLASH GAS BYPASS SYSTEMS AND METHODS FOR AN HVAC SYSTEM

(71) Applicant: Johnson Controls Technology Company, Auburn Hills, MI (US)

(72) Inventors: Praveena A. Subrahmanya, Vittal Mudnoor (IN); Nikhil N. Naik, Ratnagiri (IN); Rahul D. Kolekar, Moore, OK (US)

(73) Assignee: Johnson Controls Tyco IP Holdings LLP, Milwaukee, WI (US)

( * ) Notice: Subject to any disclaimer, the term of this patent is extended or adjusted under 35 U.S.C. 154(b) by 113 days.

(21) Appl. No.: 17/183,144

(22) Filed: Feb. 23, 2021

(65) Prior Publication Data

US 2022/0268501 A1 Aug. 25, 2022

(51) Int. Cl.

| | |
|---|---|
| ***F25B 43/00*** | (2006.01) |
| ***F25B 39/00*** | (2006.01) |
| ***F25B 39/02*** | (2006.01) |

(52) U.S. Cl.

CPC ..... *F25B 43/00* (2013.01); *F25B 39/00* (2013.01); *F25B 39/02* (2013.01); *F25B 2400/0409* (2013.01); *F25B 2400/23* (2013.01)

(58) Field of Classification Search

CPC ..... F25B 43/00; F25B 39/00; F25B 39/02; F25B 2400/0409; F25B 2400/23;

(Continued)

(56) References Cited

U.S. PATENT DOCUMENTS 6,457,325 B1 10/2002 Vetter
9,500,395 B2 11/2016 Scheumann et al.

(Continued)

FOREIGN PATENT DOCUMENTS

CN 106052182 A 3/2019
CN 107917523 B 12/2019

(Continued)

OTHER PUBLICATIONS

Tuo et al., Flash Gas Bypass in Mobile Air Conditioning System with R134a, Science Direct—International Journal of Refrigeration, Nov. 2012, pp. 1869-1877, vol. 35, Issue 7, Elsevier Ltd.

(Continued)

*Primary Examiner* — Henry T Crenshaw
*Assistant Examiner* — Kamran Tavakoldavani
(74) *Attorney, Agent, or Firm* — Fletcher Yoder, P.C.

(57) ABSTRACT

A flash gas bypass system includes a separation assembly having an inlet configured to receive a refrigerant flow from an expansion valve. A bypass conduit is coupled to a first port of the separation assembly and configured to receive a first portion of the refrigerant flow via the first port, where the first portion of the refrigerant flow includes flash gas. A second port of the separation assembly is coupled to an outlet conduit in fluid communication with an evaporator. The outlet conduit is configured to receive the second portion of the refrigerant flow via the second port and direct the second portion of the refrigerant flow toward the evaporator, where the second portion of the refrigerant flow includes liquid refrigerant. A filter is configured to redirect droplets captured by the filter from the first portion of the refrigerant flow into the second portion of the refrigerant flow.

19 Claims, 11 Drawing Sheets

(58) Field of Classification Search
CPC ..... F25B 5/02; F25B 43/003; F25B 41/20; F25B 41/42
USPC ..... 62/527
See application file for complete search history.

(56) References Cited

U.S. PATENT DOCUMENTS

| | | | | |
|---|---|---|---|---|
| 9,726,411 | B2 | 8/2017 | Zimmermann | |
| 2008/0104975 | A1* | 5/2008 | Gorbounov | F25B 43/006 62/512 |
| 2015/0153427 | A1* | 6/2015 | Garside | F25B 9/00 324/318 |
| 2020/0232673 | A1* | 7/2020 | Kozasa | F24F 12/003 |
| 2020/0271357 | A1 | 8/2020 | Miyawaki et al. | |

FOREIGN PATENT DOCUMENTS

| | | | | |
|---|---|---|---|---|
| EP | 1794510 | B1 | 2/2012 | |
| EP | 2735819 | A2 | 5/2014 | |
| WO | WO-2006083445 | A2 * | 8/2006 | F25B 41/043 |
| WO | 2015073106 | A1 | 5/2015 | |

OTHER PUBLICATIONS

Milosevic et al., Flash Gas Bypass Concept Utilizing Low Pressure Refrigerants, Master of Science in Mechanical Engineering in the Graduate College of the University of Illinois at Urbana-Champaign, 2010, 316 pgs.
Lee et al., Potential Benefits of Saturation Cycle with Two-Phase Refrigerant Injection, Science Direct—Applied Thermal Engineering, Jul. 2013, pp. 27-37, vol. 56, Issues 1-2, Elsevier Ltd.
Tuo et al., Vapor-Liquid Separation in a Vertical Impact T-Junction for Vapor Compression Systems with Flash Gas Bypass, Science Direct—International Journal of Refrigeration, Apr. 2014, pp. 189-200, vol. 40, Elsevier Ltd.
Bowers et al., Refrigerant Distribution Effects on the Performance of Microchannel Evaporators, Purdue University—International Refrigeration and Air Conditioning Conference, 2012, 11 pgs.
Mancini et al., Impact of Liquid/Vapor Maldistribution on the Performance of a Plate Heat Exchanger Evaporator for Pure and Mixed Refrigerants, Purdue University—International Refrigeration and Air Conditioning Conference, 2018, 11 pgs.
Fan et al., Experimental Study on an Inverter Heat Pump Air Conditioner with a Vapor-Bypassed Evaporator, Science Direct—International Journal of Refrigeration, Jan. 2020, pp. 180-187, vol. 109, Elsevier Ltd.
Bielskus, Two Phase Flow Distribution in Parallel Flow Heat Exchangers—Experimentally Verified Model, Master of Science in Mechanical Engineering in the Graduate College of the University of Illinois at Urbana-Champaign, 2011, 136 pgs.
Tuo, Flash Gas Bypass—A Way to Improve Distribution of Adiabatic Two-Phase Refrigerant Flow in Headers of Microchannel Evaporators, Doctor of Philosophy in Mechanical Engineering in the Graduate College of the University of Illinois at Urbana-Champaign, 2013, 204 pgs.
Refrigerant Distributors—Sporlan, Bulletin 20-10, Feb. 2011, Parker Hannifin Corporation, 24 pgs.
Operating Instruction for Bitzer Co2 Booster Rack—Bitzer, 2017, 42 pgs.
Co2 Transcritical Refrigeration, eCO2 Boost—Sales Brochure, Heatcraft Worldwide Refrigeration, 2017, 8 pgs.
General Function and Theory, Refrigeration Handbook Sec. 6.1, SWEP, 2019, 3 pgs.

* cited by examiner

FLASH GAS BYPASS SYSTEMS AND METHODS FOR AN HVAC SYSTEM

BACKGROUND

This section is intended to introduce the reader to various aspects of art that may be related to various aspects of the present disclosure, which are described below. This discussion is believed to be helpful in providing the reader with background information to facilitate a better understanding of the various aspects of the present disclosure. Accordingly, it should be understood that these statements are to be read in this light, and not as admissions of prior art.

A heating, ventilation, and/or air conditioning (HVAC) system may be used to thermally regulate an environment, such as a space within a building, home, or other structure. The HVAC system generally includes a vapor compression system having heat exchangers, such as a condenser and an evaporator, which are fluidly coupled to one another via conduits of a refrigerant loop. A compressor may be used to circulate a refrigerant through the refrigerant loop to enable the transfer of thermal energy between components of the HVAC system (e.g., the condenser, the evaporator) and the environment. Typically, an expansion device is fluidly coupled between the condenser and the evaporator and configured to regulate expansion of refrigerant (e.g., liquid refrigerant) received from the condenser and flowing toward the evaporator. In this way, the expansion device may reduce pressure and/or flow rate of the refrigerant received from the condenser prior to directing the refrigerant to the evaporator. In some cases, expansion and pressure reduction of the refrigerant flowing across the expansion device may cause at least a portion of the refrigerant to vaporize upon discharge from the expansion device. As such, the expansion device may discharge and direct a mixture of two-phase refrigerant having a liquid component and a vaporous component (e.g., flash gas) to the evaporator. It is now recognized that directing flash gas into and through the evaporator may reduce an overall operational efficiency of the HVAC system.

SUMMARY

The present disclosure relates to a flash gas bypass system that includes a separation assembly having an inlet configured to receive a refrigerant flow from an expansion valve. A bypass conduit is coupled to a first port of the separation assembly and configured to receive a first portion of the refrigerant flow via the first port, where the first portion of the refrigerant flow includes flash gas. A second port of the separation assembly is coupled to an outlet conduit in fluid communication with an evaporator. The outlet conduit is configured to receive the second portion of the refrigerant flow via the second port and direct the second portion of the refrigerant flow toward the evaporator, where the second portion of the refrigerant flow includes liquid refrigerant. A filter is configured to redirect droplets captured by the filter from the first portion of the refrigerant flow into the second portion of the refrigerant flow.

The present disclosure also relates to a heating, ventilating, and air conditioning (HVAC) system that includes a heat exchanger of a refrigerant loop and a separation assembly fluidly coupled to the heat exchanger. The separation assembly is configured to receive a flow of two-phase refrigerant from an expansion valve, where the two-phase refrigerant includes liquid refrigerant and gaseous refrigerant. The separation assembly includes a first port coupled to a bypass conduit defining a flow path along the refrigerant loop that is independent of the heat exchanger. The separation assembly includes a filter configured to enable flow of the gaseous refrigerant into the bypass conduit and block flow of the liquid refrigerant into the bypass conduit. The separation assembly also includes a second port configured to receive the liquid refrigerant and to direct flow of the liquid refrigerant into the heat exchanger.

The present disclosure also relates to a heating, ventilating, and air conditioning (HVAC) system that includes an evaporator having one or more first tubes defining a first pass for a refrigerant flow through the evaporator and one or more second tubes defining a second pass for the refrigerant flow through the evaporator. The HVAC system also includes a separation assembly fluidly coupled between the first pass and the second pass and configured to receive the refrigerant flow from the first pass. The separation assembly includes a first port configured to fluidly couple to a bypass conduit and a filter configured to enable flow of a first portion of the refrigerant flow through the first port and to block flow of a second portion of the refrigerant flow, wherein the first portion includes flash gas. The separation assembly also includes a second port coupled to the second pass and configured to direct the second portion of the refrigerant flow into the second pass, wherein the second portion includes liquid refrigerant.

DETAILED DESCRIPTION

Figure 1:
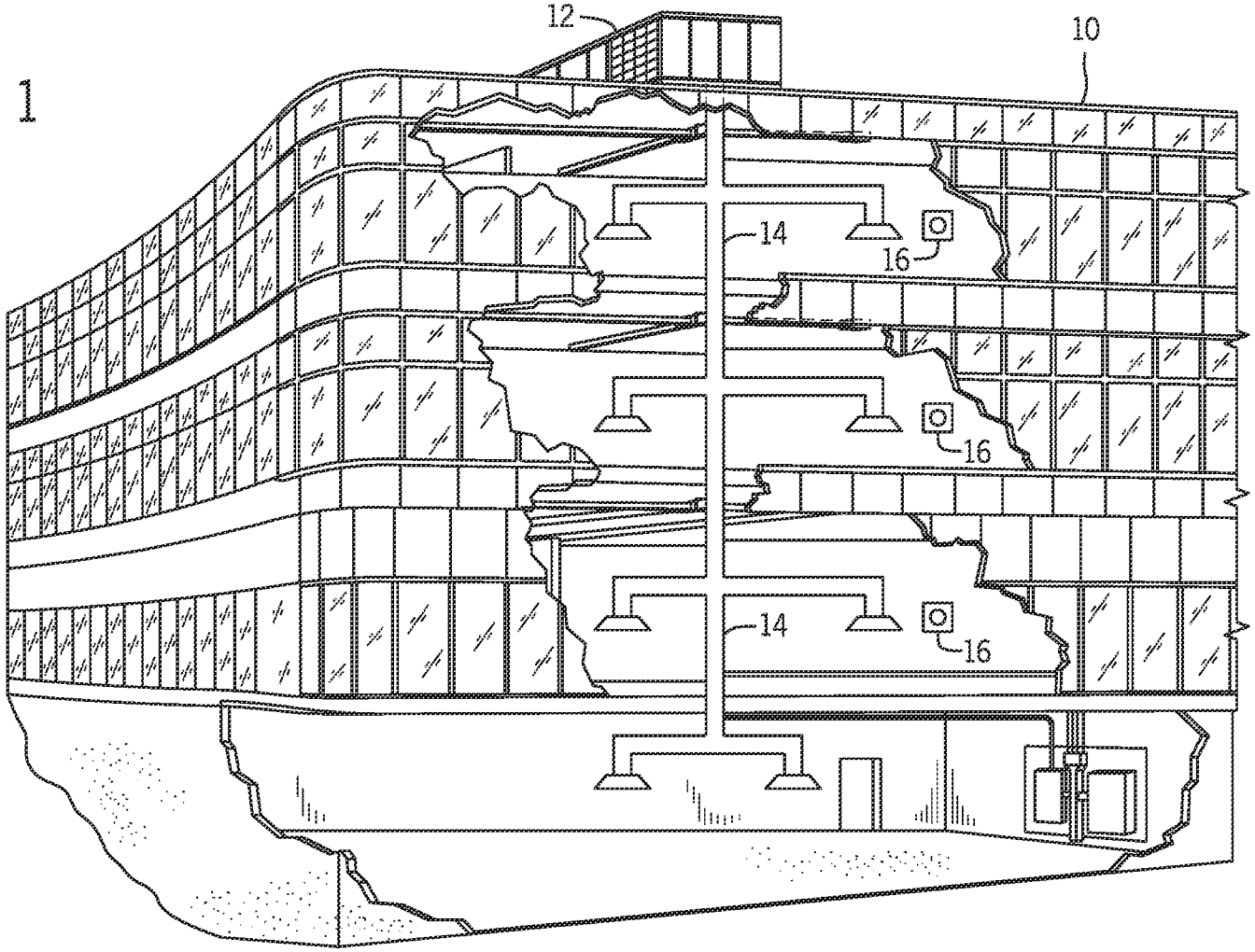
FIG. 1 is a perspective view of an embodiment of a building incorporating a heating, ventilation, and/or air conditioning (HVAC) system in a commercial setting, in accordance with an aspect of the present disclosure.

One or more specific embodiments of the present disclosure will be described below. These described embodiments are only examples of the presently disclosed techniques. Additionally, in an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

As briefly discussed above, a heating, ventilation, and/or air conditioning (HVAC) system may be used to thermally regulate a space within a building, home, or other suitable structure. For example, the HVAC system may include a vapor compression system that transfers thermal energy between a working fluid, such as a refrigerant, and a fluid to be conditioned, such as air. The vapor compression system includes a condenser and an evaporator that are fluidly coupled to one another via one or more conduits of a refrigerant loop. A compressor may be used to circulate the refrigerant through the conduits and other components of the refrigerant loop (e.g., an expansion device) and, thus, enable the transfer of thermal energy between components of the refrigerant loop (e.g., between the condenser and the evaporator) and one or more thermal loads (e.g., an environmental air flow, a supply air flow).

Generally, the compressor is configured to draw a flow of substantially gaseous refrigerant from the evaporator, compress the gaseous refrigerant into a high-pressure refrigerant gas, and direct the high-pressure refrigerant gas into the condenser. The condenser is configured to facilitate condensation of the refrigerant gas, such that the refrigerant may discharge from the condenser as high-pressure liquid refrigerant. An expansion device (e.g., expansion valve) is typically disposed along the refrigerant loop between the condenser and the evaporator and configured to receive the high-pressure liquid refrigerant discharging from the condenser. The expansion device may expand (e.g., reduce a pressure of) the high-pressure liquid refrigerant received from the condenser prior to directing the refrigerant to the evaporator. In some cases, expansion of the liquid refrigerant received at the expansion device may cause at least a portion of the liquid refrigerant to vaporize and discharge from the expansion device in a gaseous state. Gaseous refrigerant that is discharged from the expansion device during operation of the HVAC system will be referred to herein as "flash gas." As such, typical expansion devices may direct a two-phase mixture of liquid refrigerant and flash gas into the evaporator, which is disposed downstream of the expansion device (e.g., with respect to a direction of refrigerant flow through the refrigerant loop). Unfortunately, directing flash gas into the evaporator alongside liquid refrigerant may decrease an overall rate of heat exchange between the refrigerant flowing through the evaporator and a fluid (e.g., air) that may be directed across the evaporator. As a result, directing flash gas into and through the evaporator may reduce an operational efficiency of the HVAC system.

Accordingly, embodiments of the present disclosure are directed to a flash gas bypass system that is configured to inhibit or substantially mitigate flow of flash gas from the expansion device into the evaporator. For example, the flash gas bypass system includes one or more separation components that are configured to receive the two-phase refrigerant mixture that may typically discharge from the expansion device during operation of the HVAC system. The separation components are configured to facilitate separation of liquid refrigerant and flash gas from the two-phase refrigerant mixture. In particular, the separation components are configured to direct or otherwise divert the liquid refrigerant discharging from the expansion device into the evaporator while directing or otherwise diverting the flash gas into a bypass line. As discussed in detail herein, the bypass line enables the flash gas received from the separation components to bypass the evaporator and flow toward the compressor without flowing through the evaporator. To this end, the flash gas bypass system ensures that substantially all flash gas that may be generated via refrigerant flow across the expansion device bypasses the evaporator and that the refrigerant received by the evaporator (e.g., from the expansion device) is in a substantially liquid state.

By reducing or substantially eliminating a gaseous component (e.g., flash gas) of the refrigerant flowing through the evaporator, the flash gas bypass system may enhance an effective rate of heat transfer between the remaining refrigerant (e.g., substantially liquid refrigerant) circulating through the evaporator and a fluid flow (e.g., an air flow) directed across the evaporator. In this way, the flash gas bypass system may enhance an overall operational efficiency of the HVAC system. For clarity, as used herein, discussion of a refrigerant in a "substantially liquid state" or "liquid refrigerant" may refer to refrigerant having a phase composition that is 94 percent, 95 percent, 96 percent, 97 percent, 98 percent or more liquid refrigerant and 6 percent, 5 percent, 4 percent, 3 percent, 2 percent or less flash gas (e.g., gaseous refrigerant). As used herein, the "phase composition" of a fluid may refer to a ratio correlating an amount of fluid that is in a liquid state or phase to an amount of the fluid that is in a gaseous (e.g., vapor) state or phase. Moreover, as used herein, "flash gas" may refer to refrigerant having a phase composition that is 94 percent, 95 percent, 96 percent, 97 percent, 98 percent or more gaseous refrigerant and 6 percent, 5 percent, 4 percent, 3 percent, 2 percent or less liquid refrigerant. These and other features will be described below with reference to the drawings.

Turning now to the drawings, FIG. 1 illustrates an embodiment of a heating, ventilation, and/or air conditioning (HVAC) system for environmental management that employs one or more HVAC units in accordance with the present disclosure. As used herein, an HVAC system includes any number of components configured to enable regulation of parameters related to climate characteristics, such as temperature, humidity, air flow, pressure, air quality, and so forth. For example, an "HVAC system" as used herein is defined as conventionally understood and as further described herein. Components or parts of an "HVAC system" may include, but are not limited to, all, some of, or individual parts such as a heat exchanger, a heater, an air flow control device, such as a fan, a sensor configured to detect a climate characteristic or operating parameter, a filter, a control device configured to regulate operation of an HVAC system component, a component configured to enable regulation of climate characteristics, or a combination thereof. An "HVAC system" is a system configured to provide such functions as heating, cooling, ventilation, dehumidification, pressurization, refrigeration, filtration, or any combination thereof. The embodiments described herein may be utilized in a variety of applications to control climate characteristics, such as residential, commercial, industrial, transportation, or other applications where climate control is desired.

In the illustrated embodiment, a building 10 is air conditioned by a system that includes an HVAC unit 12 with a flash gas bypass system in accordance with present embodiments. The building 10 may be a commercial structure or a residential structure. As shown, the HVAC unit 12 is disposed on the roof of the building 10; however, the HVAC unit 12 may be located in other equipment rooms or areas adjacent the building 10. The HVAC unit 12 may be a single package unit containing other equipment, such as a blower, integrated air handler, and/or auxiliary heating unit. In other embodiments, the HVAC unit 12 may be part of a split HVAC system, such as the system shown in FIG. 3, which includes an outdoor HVAC unit 58 and an indoor HVAC unit 56.

The HVAC unit 12 is an air cooled device that implements a refrigeration cycle to provide conditioned air to the building 10. Specifically, the HVAC unit 12 may include one or more heat exchangers across which an air flow is passed to condition the air flow before the air flow is supplied to the building. In the illustrated embodiment, the HVAC unit 12 is a rooftop unit (RTU) that conditions a supply air stream, such as environmental air and/or a return air flow from the building 10. After the HVAC unit 12 conditions the air, the air is supplied to the building 10 via ductwork 14 extending throughout the building 10 from the HVAC unit 12. For example, the ductwork 14 may extend to various individual floors or other sections of the building 10. In certain embodiments, the HVAC unit 12 may be a heat pump that provides both heating and cooling to the building with one refrigeration circuit configured to operate in different modes. In other embodiments, the HVAC unit 12 may include one or more refrigeration circuits for cooling an air stream and a furnace for heating the air stream.

A control device 16, one type of which may be a thermostat, may be used to designate the temperature of the conditioned air. The control device 16 also may be used to control the flow of air through the ductwork 14. For example, the control device 16 may be used to regulate operation of one or more components of the HVAC unit 12 or other components, such as dampers and fans, within the building 10 that may control flow of air through and/or from the ductwork 14. In some embodiments, other devices may be included in the system, such as pressure and/or temperature transducers or switches that sense the temperatures and pressures of the supply air, return air, and so forth. Moreover, the control device 16 may include computer systems that are integrated with or separate from other building control or monitoring systems, and even systems that are remote from the building 10.

Figure 2:
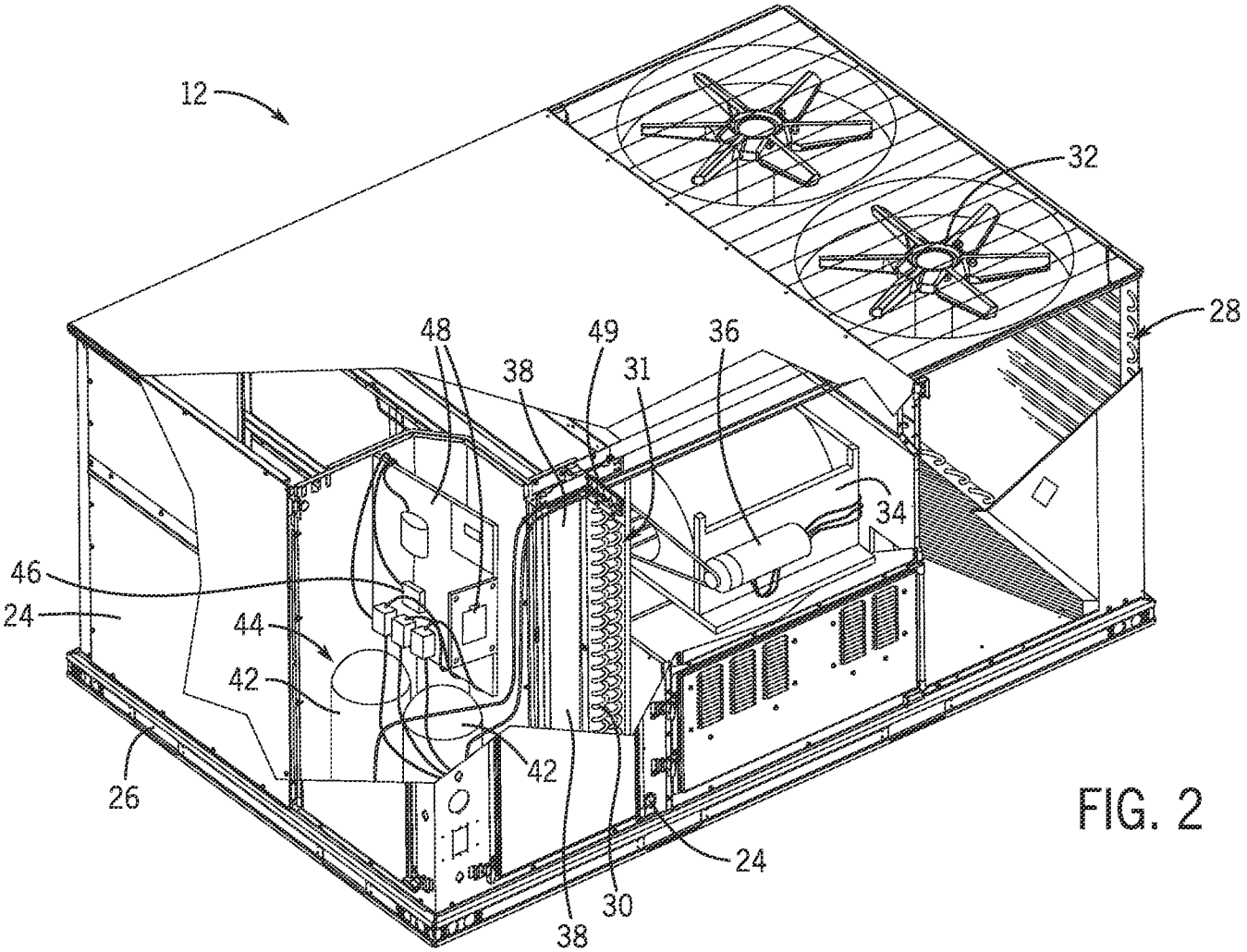
FIG. 2 is a perspective view of an embodiment of a packaged HVAC unit, in accordance with an aspect of the present disclosure.

FIG. 2 is a perspective view of an embodiment of the HVAC unit 12 that includes a flash gas bypass system in accordance with present embodiments. In the illustrated embodiment, the HVAC unit 12 is a single package unit that may include one or more independent refrigeration circuits and components that are tested, charged, wired, piped, and ready for installation. The HVAC unit 12 may provide a variety of heating and/or cooling functions, such as cooling only, heating only, cooling with electric heat, cooling with dehumidification, cooling with gas heat, or cooling with a heat pump. As described above, the HVAC unit 12 may directly cool and/or heat an air stream provided to the building 10 to condition a space in the building 10.

As shown in the illustrated embodiment of FIG. 2, a cabinet 24 encloses the HVAC unit 12 and provides structural support and protection to the internal components from environmental and other contaminants. In some embodiments, the cabinet 24 may be constructed of galvanized steel and insulated with aluminum foil faced insulation. Rails 26 may be joined to the bottom perimeter of the cabinet 24 and provide a foundation for the HVAC unit 12. In certain embodiments, the rails 26 may provide access for a forklift and/or overhead rigging to facilitate installation and/or removal of the HVAC unit 12. In some embodiments, the rails 26 may fit into "curbs" on the roof to enable the HVAC unit 12 to provide air to the ductwork 14 from the bottom of the HVAC unit 12 while blocking elements such as rain from leaking into the building 10.

The HVAC unit 12 includes heat exchangers 28 and 30 in fluid communication with one or more refrigeration circuits. Tubes within the heat exchangers 28 and 30 may circulate refrigerant, such as R-410A, through the heat exchangers 28 and 30. The tubes may be of various types, such as multichannel tubes, conventional copper or aluminum tubing, and so forth. Together, the heat exchangers 28 and 30 may implement a thermal cycle in which the refrigerant undergoes phase changes and/or temperature changes as it flows through the heat exchangers 28 and 30 to produce heated and/or cooled air. For example, the heat exchanger 28 may function as a condenser where heat is released from the refrigerant to ambient air, and the heat exchanger 30 may function as an evaporator where the refrigerant absorbs heat to cool an air stream. In other embodiments, the HVAC unit 12 may operate in a heat pump mode where the roles of the heat exchangers 28 and 30 may be reversed. That is, the heat exchanger 28 may function as an evaporator and the heat exchanger 30 may function as a condenser. In further embodiments, the HVAC unit 12 may include a furnace for heating the air stream that is supplied to the building 10. While the illustrated embodiment of FIG. 2 shows the HVAC unit 12 having two of the heat exchangers 28 and 30, in other embodiments, the HVAC unit 12 may include one heat exchanger or more than two heat exchangers.

The heat exchanger 30 is located within a compartment 31 that separates the heat exchanger 30 from the heat exchanger 28. Fans 32 draw air from the environment through the heat exchanger 28. Air may be heated and/or cooled as the air flows through the heat exchanger 28 before being released back to the environment surrounding the HVAC unit 12. A blower assembly 34, powered by a motor 36, draws air through the heat exchanger 30 to heat or cool the air. The heated or cooled air may be directed to the building 10 by the ductwork 14, which may be connected to the HVAC unit 12. Before flowing through the heat exchanger 30, the conditioned air flows through one or more filters 38 that may remove particulates and contaminants from the air. In certain embodiments, the filters 38 may be disposed on the air intake side of the heat exchanger 30 to prevent contaminants from contacting the heat exchanger 30.

The HVAC unit 12 also may include other equipment for implementing the thermal cycle. Compressors 42 increase the pressure and temperature of the refrigerant before the refrigerant enters the heat exchanger 28. The compressors 42 may be any suitable type of compressors, such as scroll compressors, rotary compressors, screw compressors, or reciprocating compressors. In some embodiments, the compressors 42 may include a pair of hermetic direct drive compressors arranged in a dual stage configuration 44. However, in other embodiments, any number of the compressors 42 may be provided to achieve various stages of heating and/or cooling. As may be appreciated, additional equipment and devices may be included in the HVAC unit 12, such as a solid-core filter drier, a drain pan, a disconnect switch, an economizer, pressure switches, phase monitors, and humidity sensors, among other things.

The HVAC unit 12 may receive power through a terminal block 46. For example, a high voltage power source may be connected to the terminal block 46 to power the equipment. The operation of the HVAC unit 12 may be governed or regulated by a control board 48. The control board 48 may include control circuitry connected to a thermostat, sensors, and alarms. One or more of these components may be referred to herein separately or collectively as the control device 16. The control circuitry may be configured to control operation of the equipment, provide alarms, and monitor safety switches. Wiring 49 may connect the control board 48 and the terminal block 46 to the equipment of the HVAC unit 12.

Figure 3:
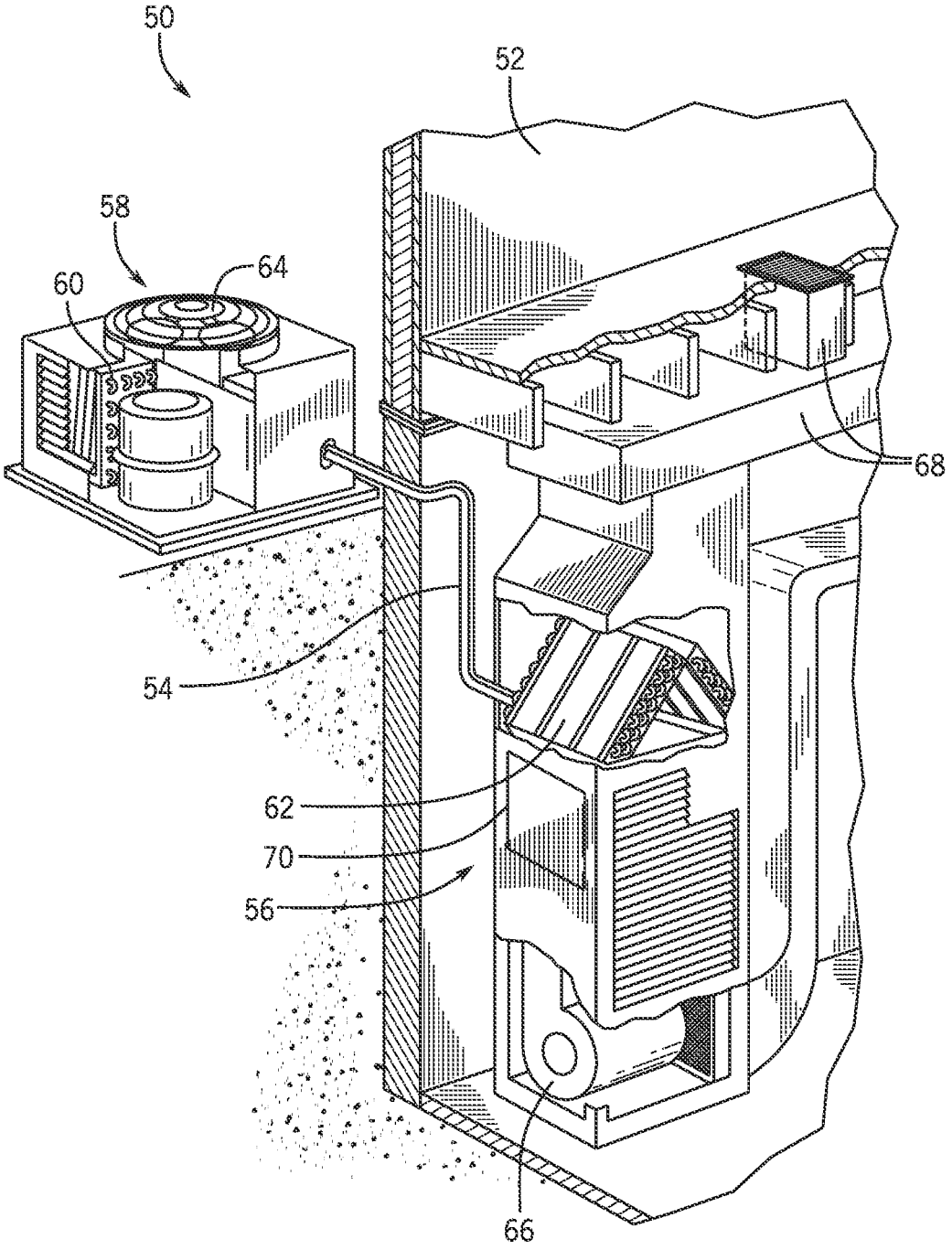
FIG. 3 is a perspective view of an embodiment of a split, residential HVAC system, in accordance with an aspect of the present disclosure.

FIG. 3 illustrates a residential heating and cooling system 50, also in accordance with present techniques. The residential heating and cooling system 50 may provide heated and cooled air to a residential structure, as well as provide outside air for ventilation and provide improved indoor air quality (IAQ) through devices such as ultraviolet lights and air filters. In the illustrated embodiment, the residential heating and cooling system 50 is a split HVAC system. In general, a residence 52 conditioned by a split HVAC system may include refrigerant conduits 54 that operatively couple the indoor unit 56 to the outdoor unit 58. The indoor unit 56 may be positioned in a utility room, an attic, a basement, and so forth. The outdoor unit 58 is typically situated adjacent to a side of residence 52 and is covered by a shroud to protect the system components and to prevent leaves and other debris or contaminants from entering the unit. The refrigerant conduits 54 transfer refrigerant between the indoor unit 56 and the outdoor unit 58, typically transferring primarily liquid refrigerant in one direction and primarily vaporized refrigerant in an opposite direction.

When the system shown in FIG. 3 is operating as an air conditioner, a heat exchanger 60 in the outdoor unit 58 serves as a condenser for re-condensing vaporized refrigerant flowing from the indoor unit 56 to the outdoor unit 58 via one of the refrigerant conduits 54. In these applications, a heat exchanger 62 of the indoor unit functions as an evaporator. Specifically, the heat exchanger 62 receives liquid refrigerant, which may be expanded by an expansion device, and evaporates the refrigerant before returning it to the outdoor unit 58.

The outdoor unit 58 draws environmental air through the heat exchanger 60 using a fan 64 and expels the air above the outdoor unit 58. When operating as an air conditioner, the air is heated by the heat exchanger 60 within the outdoor unit 58 and exits the unit at a temperature higher than it entered. The indoor unit 56 includes a blower or fan 66 that directs air through or across the indoor heat exchanger 62, where the air is cooled when the system is operating in air conditioning mode. Thereafter, the air is passed through ductwork 68 that directs the air to the residence 52. The overall system operates to maintain a desired temperature as set by a system controller. When the temperature sensed inside the residence 52 is higher than the set point on the thermostat, or the set point plus a small amount, the residential heating and cooling system 50 may become operative to refrigerate additional air for circulation through the residence 52. When the temperature reaches the set point, or the set point minus a small amount, the residential heating and cooling system 50 may stop the refrigeration cycle temporarily. The indoor unit 56 and/or the outdoor unit 58 includes a flash gas bypass system in accordance with present embodiments.

The residential heating and cooling system 50 may also operate as a heat pump. When operating as a heat pump, the roles of heat exchangers 60 and 62 are reversed. That is, the heat exchanger 60 of the outdoor unit 58 will serve as an evaporator to evaporate refrigerant and thereby cool air entering the outdoor unit 58 as the air passes over the outdoor heat exchanger 60. The indoor heat exchanger 62 will receive a stream of air blown over it and will heat the air by condensing the refrigerant.

In some embodiments, the indoor unit 56 may include a furnace system 70. For example, the indoor unit 56 may include the furnace system 70 when the residential heating and cooling system 50 is not configured to operate as a heat pump. The furnace system 70 may include a burner assembly and heat exchanger, among other components, inside the indoor unit 56. Fuel is provided to the burner assembly of the furnace 70 where it is mixed with air and combusted to form combustion products. The combustion products may pass through tubes or piping in a heat exchanger, separate from heat exchanger 62, such that air directed by the blower 66 passes over the tubes or pipes and extracts heat from the combustion products. The heated air may then be routed from the furnace system 70 to the ductwork 68 for heating the residence 52.

Figure 4:
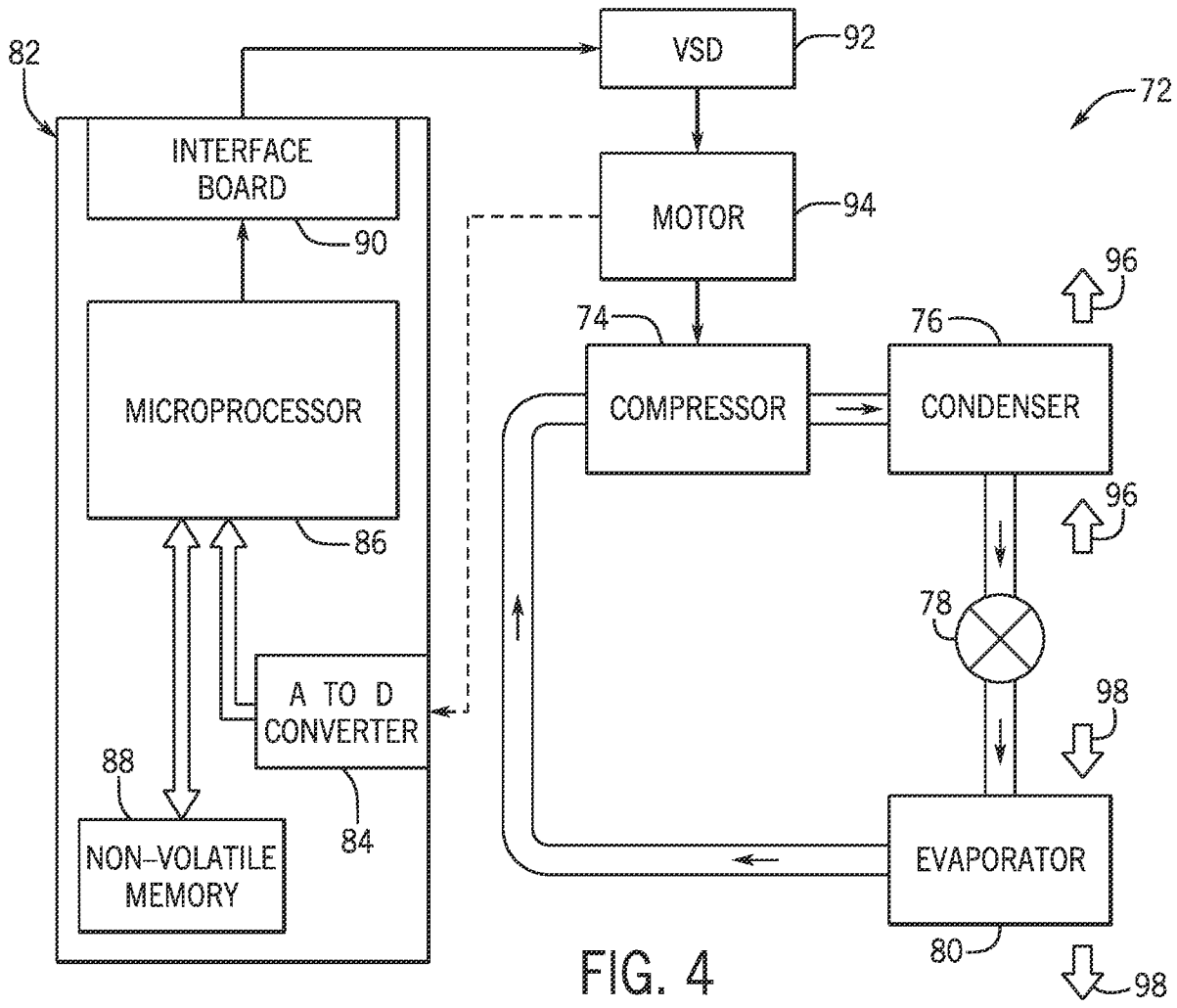
FIG. 4 is a schematic diagram of an embodiment of a vapor compression system used in an HVAC system, in accordance with an aspect of the present disclosure.

FIG. 4 is an embodiment of a vapor compression system 72 that can be used in any of the systems described above. The vapor compression system 72 may circulate a refrigerant through a circuit starting with a compressor 74. The circuit may also include a condenser 76, an expansion valve(s) or device(s) 78, and an evaporator 80. The vapor compression system 72 may further include a control panel 82 that has an analog to digital (A/D) converter 84, a microprocessor 86, a non-volatile memory 88, and/or an interface board 90. The control panel 82 and its components may function to regulate operation of the vapor compression system 72 based on feedback from an operator, from sensors of the vapor compression system 72 that detect operating conditions, and so forth.

In some embodiments, the vapor compression system 72 may use one or more of a variable speed drive (VSDs) 92, a motor 94, the compressor 74, the condenser 76, the expansion valve or device 78, and/or the evaporator 80. The motor 94 may drive the compressor 74 and may be powered by the variable speed drive (VSD) 92. The VSD 92 receives alternating current (AC) power having a particular fixed line voltage and fixed line frequency from an AC power source, and provides power having a variable voltage and frequency to the motor 94. In other embodiments, the motor 94 may be powered directly from an AC or direct current (DC) power source. The motor 94 may include any type of electric motor that can be powered by a VSD or directly from an AC or DC power source, such as a switched reluctance motor, an induction motor, an electronically commutated permanent magnet motor, or another suitable motor.

The compressor 74 compresses a refrigerant vapor and delivers the vapor to the condenser 76 through a discharge passage. In some embodiments, the compressor 74 may be a centrifugal compressor. The refrigerant vapor delivered by the compressor 74 to the condenser 76 may transfer heat to a fluid passing across the condenser 76, such as ambient or environmental air 96. The refrigerant vapor may condense to a refrigerant liquid in the condenser 76 as a result of thermal heat transfer with the environmental air 96. The liquid refrigerant from the condenser 76 may flow through the expansion device 78 to the evaporator 80. In the illustrated embodiment, a flash gas bypass configuration in accordance with present embodiments is provided (as represented by the expansion device 78) such that liquid refrigerant is delivered to the evaporator without any substantial amount of vapor refrigerant.

The liquid refrigerant delivered to the evaporator 80 may absorb heat from another air stream, such as a supply air stream 98 provided to the building 10 or the residence 52. For example, the supply air stream 98 may include ambient or environmental air, return air from a building, or a combination of the two. The liquid refrigerant in the evaporator 80 may undergo a phase change from the liquid refrigerant to a refrigerant vapor. In this manner, the evaporator 80 may reduce the temperature of the supply air stream 98 via thermal heat transfer with the refrigerant. Thereafter, the vapor refrigerant exits the evaporator 80 and returns to the compressor 74 by a suction line to complete the cycle.

In some embodiments, the vapor compression system 72 may further include a reheat coil. In the illustrated embodiment, the reheat coil is represented as part of the evaporator 80. The reheat coil is positioned downstream of the evaporator heat exchanger relative to the supply air stream 98 and may reheat the supply air stream 98 when the supply air stream 98 is overcooled to remove humidity from the supply air stream 98 before the supply air stream 98 is directed to the building 10 or the residence 52. In certain embodiments, the vapor compression system 72 may include a flash gas bypass system as disclosed herein. In the illustrated embodiment of FIG. 4, the flash gas bypass system is represented as part of the expansion device 78.

It should be appreciated that any of the features described herein may be incorporated with the HVAC unit 12, the residential heating and cooling system 50, or other HVAC systems. Additionally, while the features disclosed herein are described in the context of embodiments that directly heat and cool a supply air stream provided to a building or other load, embodiments of the present disclosure may be applicable to other HVAC systems as well. For example, the features described herein may be applied to mechanical cooling systems, free cooling systems, chiller systems, or other heat pump or refrigeration applications.

Figure 5:
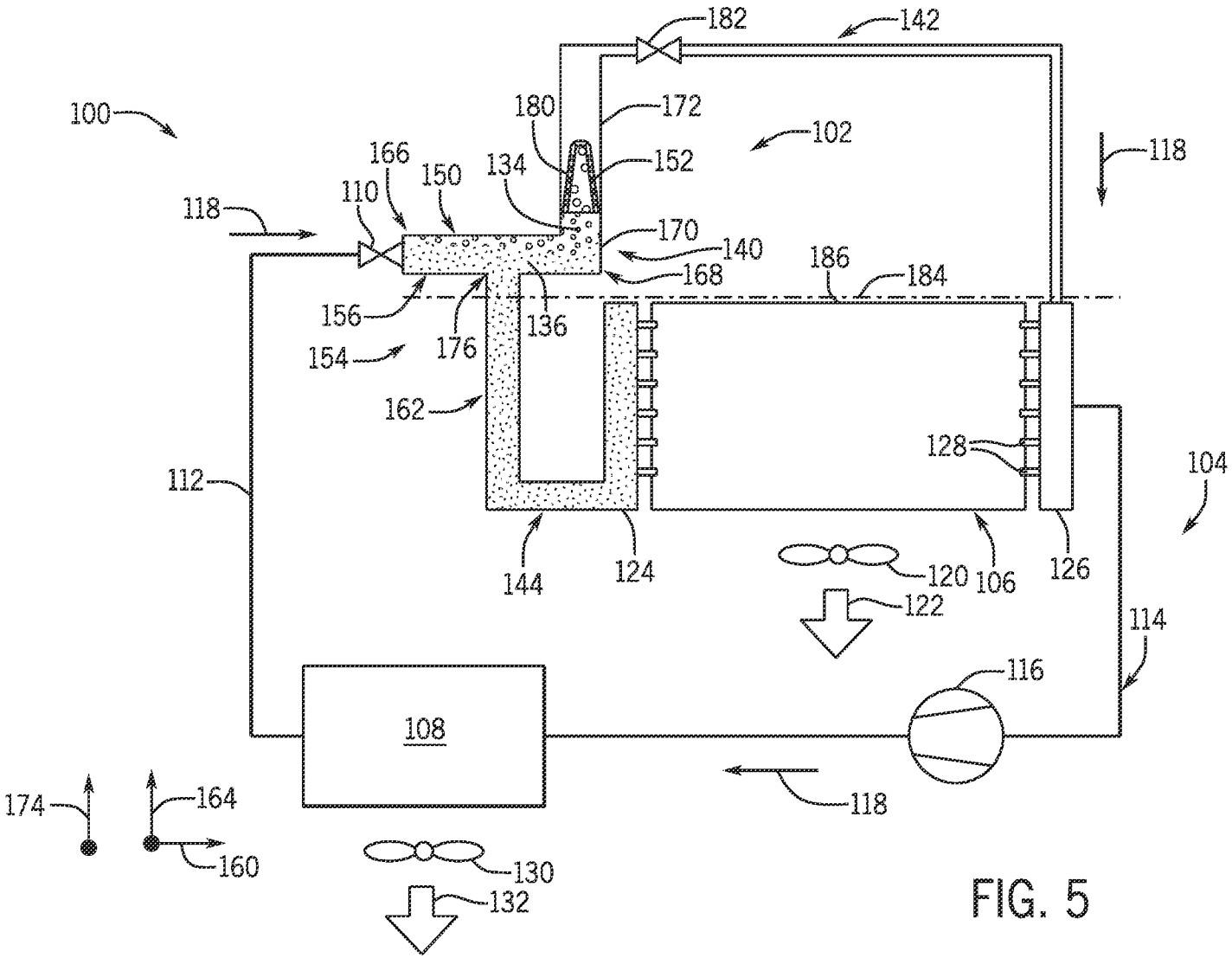
FIG. 5 is a schematic diagram of an embodiment of a portion of an HVAC system that includes a flash gas bypass system having an offset impact junction, in accordance with an aspect of the present disclosure.

As briefly discussed above, embodiments of the present disclosure are directed to a flash gas bypass system that is configured to inhibit or substantially mitigate flow of flash gas from an expansion device (e.g., the expansion device 78) into an evaporator (e.g., the indoor heat exchanger 62, the evaporator 80). To provide context for the following discussion, FIG. 5 is a schematic of an embodiment of a portion of an HVAC system 100 having a flash gas bypass system 102. The HVAC system 100 may be configured to direct a flow of conditioned air (e.g., heated air, cooled air, dehumidified air) to a thermal load, such as a space within a building, residential home, or other suitable structure. It should be appreciated that the HVAC system 100 may include embodiments or components of the HVAC unit 12 shown in FIGS. 1 and 2, embodiments or components of the split residential heating and cooling system 50 shown in FIG. 3, a rooftop unit (RTU), or any other suitable air handling unit or HVAC system.

In the illustrated embodiment, the HVAC system 100 includes a vapor compression system 104, such as the vapor compression system 72. The vapor compression system 104 includes an evaporator 106 (e.g., the indoor heat exchanger 62, the evaporator 80), a condenser 108 (e.g., the outdoor heat exchanger 60, the condenser 108), and an expansion device 110 (e.g., the expansion valve 78, an electronic expansion valve) that are fluidly coupled to one another via conduits 112. As such, the conduits 112, the evaporator 106, the condenser 108, and the expansion device 110 may form at least a portion of a refrigerant loop 114 of the vapor compression system 104. Generally, a compressor 116 (e.g., the compressor 74) is fluidly coupled to the conduits 112 and configured to circulate a refrigerant along the refrigerant loop 114 in a downstream direction 118, for example. That is, to circulate the refrigerant through the refrigerant loop 114 in the downstream direction 118, the compressor 116 may draw the refrigerant from the evaporator 106, force the refrigerant through the condenser 108 and the expansion device 110, and direct the refrigerant back into the evaporator 106.

The HVAC system 100 may include one or more indoor fans 120 configured to draw a flow of supply air 122 across the evaporator 106. As such, the supply air 122 may release thermal energy to the refrigerant circulating through the evaporator 106 and may discharge from the evaporator 106 as a flow of conditioned air (e.g., cooled air). The indoor fans 120 may direct the conditioned air to one or more rooms, zones, or other spaces of the building 10 or of another suitable structure serviced by the HVAC system 100. As shown in the illustrated embodiments, the evaporator 106 includes an inlet header 124, an outlet header 126, and a plurality of tubes 128 extending therebetween. As discussed in detail below, the evaporator 106 may include a microchannel heat exchanger, a round tube plate fin (RTPF) heat exchanger, or another suitable heat exchanger.

In some embodiments, the HVAC system 100 includes one or more outdoor fans 130 configured to draw a flow of outdoor air 132 (e.g., ambient air) across the condenser 108. Accordingly, the outdoor air 132 may absorb thermal energy from the refrigerant flowing through the condenser 108 to cool the refrigerant and cause the refrigerant to condense within the condenser 108. For example, refrigerant flowing through the evaporator 106 may absorb an amount of thermal energy from the supply air 122 that is sufficient to cause the refrigerant to boil. As such, the refrigerant may discharge from the evaporator 106 as a low-pressure gas and may flow toward the compressor 116. The compressor 116 may compress the low-pressure gaseous refrigerant received from the evaporator 106 to increase a pressure of the refrigerant and discharge the refrigerant as a high-pressure gas. Accordingly, the condenser 108 may receive a flow of the high-pressure gaseous refrigerant from the compressor 116. In some embodiments, the outdoor air 132 directed across the condenser 108 by the outdoor fans 130 may absorb an amount of thermal energy from the high-pressure gaseous refrigerant entering the condenser 108 that is sufficient to cause the refrigerant to condense within the condenser 108. Accordingly, the condenser 108 may output a flow of high-pressure liquid refrigerant toward the expansion device 110. In certain embodiments, the expansion device 110 may therefore receive the refrigerant from the condenser 108 in a substantially liquid state.

As discussed above, the expansion device 110 may expand (e.g., reduce a pressure of) the high-pressure liquid refrigerant received from the condenser 108 prior to directing the refrigerant toward the evaporator 106. In some cases, expansion of refrigerant via the expansion device 110 may cause at least a portion of the liquid refrigerant received at the expansion device 110 to vaporize and discharge from the expansion device 110 in a gaseous state. Gaseous refrigerant that is discharged from the expansion device 110 during operation of the HVAC system 100 will be referred to herein as "flash gas 134." As such, it should be understood that, during operation of the vapor compression system 104, the expansion device 110 may discharge a two-phase mixture of refrigerant that includes a liquid component (e.g., liquid refrigerant 136) and a gaseous component (e.g., the flash gas 134).

The flash gas bypass system 102 includes one or more separation components 140 that are configured to receive the two-phase mixture of the liquid refrigerant 136 and the flash gas 134 and to separate substantially all of the flash gas 134 from the liquid refrigerant 136. Specifically, as discussed in detail herein, the separation components 140 may divert substantially all of the flash gas 134 discharging from the expansion device 110 into and through a bypass line 142 (e.g., bypass conduit) of the flash gas bypass system 102 while directing the liquid refrigerant 136 toward and into the evaporator 106 (e.g., via a header conduit 144). As such, the separation components 140 may ensure that the refrigerant received at and flowing into the evaporator 106 is in the substantially liquid state and is substantially devoid of the flash gas 134. For clarity, as used herein, diverting "substantially all" of the flash gas 134 into the bypass line 142 may refer to diverting 94 percent, 95 percent, 96 percent, 97 percent, 98 percent or more of the flash gas 134 output by the expansion device 110 into the bypass line 142 via the flash gas bypass system 102. Moreover, as used herein, diverting "substantially all" of the liquid refrigerant 136 to the evaporator 106 (e.g., via the header conduit 144) may refer to diverting 94 percent, 95 percent, 96 percent, 97 percent, 98 percent or more of the liquid refrigerant 136 output by the expansion device 110 into the evaporator 106 via the flash gas bypass system 102.

For example, the bypass line 142 may extend from the one or more separation components 140 to a component of the vapor compression system 104 that is positioned downstream of the plurality of tubes 128 (e.g., with respect to a direction of refrigerant flow through the evaporator 106). As an example, the bypass line 142 may extend from the one or more separation components 140 to the outlet header 126 of the evaporator 106. However, in other embodiments, the bypass line 142 may be fluidly coupled to any other suitable portion or component of the refrigerant loop 114 in lieu of the outlet header 126. In any case, the bypass line 142 enables the flash gas 134 flowing from the expansion device 110 to bypass the evaporator 106 and flow toward the condenser 108 (e.g., in the downstream direction 118) without flowing through the evaporator 106. The header conduit 144 may extend from the one or more separation components 140 to the inlet header 124 of the evaporator 106 and/or may form a portion of the one or more separation components 140. As such, the header conduit 144 may direct the liquid refrigerant 136 received from the separation components 140 toward and into the evaporator 106.

In the illustrated embodiment, the one or more separation components 140 include an offset impact junction 150 and a filter 152. The offset impact junction 150 and the filter 152 may form part of or all of a first separation assembly 154 of the flash gas bypass system 102. The first separation assembly 154 may also be referred to herein as an offset type separation assembly 154. As used herein, a "separation assembly" may be indicative of one or more components of the flash gas bypass system 102 that are configured to inhibit or substantially mitigate flow of flash gas (e.g., from the expansion device 110) into the evaporator 106. The offset impact junction 150 includes a first leg 156 that may extend generally along a horizontal axis 160 (e.g., with respect to a direction of gravity) and a second leg 162 (e.g., an outlet conduit) that extends generally along a vertical axis 164 (e.g., with respect to the direction of gravity). For clarity, discussions herein relating to an axis or direction extending "generally along" another reference axis or reference direction may be indicative of the axis or direction being aligned (e.g., parallel) within a threshold angle (e.g., less than 5 degrees) of the reference axis or the reference direction. Moreover, it should be understood that discussion herein relating to certain components being "vertically above" or "vertically below" other components are with respect to the direction of gravity. Moreover, discussion herein relating to certain components being "downstream" or "upstream" of other components are with respect to the direction of refrigeration flow through the compressor 116 and along the refrigerant loop 114.

The first leg 156 may include a first end portion 166 that is fluidly coupled to the expansion device 110 and a second end portion 168 that terminates at a wall 170 of the offset impact junction 150. The second end portion 168 includes a port that is fluidly coupled to an initial section 172 of the bypass line 142. The initial section 172 may extend from the second end portion 168 in an upward direction 174 (e.g., a direction that extends generally opposite to the direction of gravity) and generally along the vertical axis 164. In some embodiments, the filter 152 may be disposed within and extend along a portion of the initial section 172, as shown in the illustrated embodiment of FIG. 5. The second leg 162 may be fluidly coupled to the first leg 156 at an intermediate port 176 (e.g., intermediate inlet) that may be positioned between the first end portion 166 and the second end portion 168. As used herein, a "port" may be indicative of an inlet, outlet, coupler, opening, or channel.

During operation of the HVAC system 100, two-phase refrigerant discharging from the expansion device 110 may enter the first leg 156 and flow in the downstream direction 118 along the first leg 156 from the first end portion 166 to the second end portion 168. Generally, gravity may cause the flash gas 134 to accumulate vertically above the liquid refrigerant 136 flowing though the first leg 156. As such, as shown in the illustrated embodiment of FIG. 5, substantially all of the flash gas 134 approaching the intermediate port 176 (e.g., when flowing in the downstream direction 118) may be positioned above the liquid refrigerant 136 and, thus, flow across and over the intermediate port 176, while the liquid refrigerant 136 may flow through the intermediate port 176 and into the second leg 162. The second leg 162 is fluidly coupled to the header conduit 144 and/or may form a portion of the header conduit 144. As such, the second leg 162 may direct the liquid refrigerant 136 entering the intermediate port 176 toward and into the evaporator 106.

The flash gas 134 flowing across and over the intermediate port 176 may impinge upon the wall 170 alongside residual liquid refrigerant 136 that has not yet flown through the intermediate port 176. The flash gas 134 may flow into the initial section 172 of the bypass line 142, through the filter 152, and into a remainder of the bypass line 142. Next, the flash gas 134 may flow along the bypass line 142 and into the outlet header 126 of the evaporator 106. In this way, the flash gas 134 may flow through the outlet header 126 and back to the compressor 116 while bypassing the plurality of tubes 128 of the evaporator 106. As such, in accordance with the aforementioned arrangement, the first separation assembly 154 may facilitate diverting substantially all of the flash gas 134 through the bypass line 142 while directing the liquid refrigerant 136 to the evaporator 106.

In certain embodiments, the filter 152 may include a perforated mesh 180 or other material that is configured to block or substantially mitigate droplets of liquid refrigerant 136 from passing through the filter 152 and entering a remainder of the bypass line 142. For example, in certain embodiments, impingement of the liquid refrigerant 136 and the flash gas 134 onto the wall 170 may cause liquid refrigerant droplets to separate from a remainder of the liquid refrigerant 136 and splash (e.g., project) in the upward direction 174. The perforated mesh 180 of the filter 152 may be sized to enable flow of the flash gas 134 through the filter 152 (e.g., in the downstream direction 118) while substantially blocking flow of the liquid refrigerant 136 droplets through the filter 152. As such, the liquid refrigerant 136 droplets engaging with the perforated mesh 180 may drip back into the first leg 156 and eventually flow toward and into the second leg 162 (e.g., via the intermediate port 176). As a non-limiting example, the perforated mesh 180 may includes a plurality of openings each having a diameter between about 0.1 millimeters and 1.0 millimeters. The perforated mesh 180 may include copper or stainless steel wire mesh, copper or other metal foam, a perforated sheet of material, or another suitable filter material. In some embodiments, a portion of or all of the filter 152 includes a conical cross-sectional profile. In other embodiments, the filter 152 may include a planar, concave, or convex piece of cross-sectional profile. Still further, the filter 152 may include a polygonal and/or non-symmetrically shaped cross-sectional profile. Moreover, in certain embodiments, the filter 152 may be omitted from the first separation assembly 154. In such embodiments, a length of the initial section 172 may be sized such that gravity substantially blocks liquid refrigerant 136 droplets from being cast along the initial section 172 (e.g., in the upward direction 174) and into a remainder of the bypass line 142.

In the illustrated embodiment, the flash gas bypass system 102 includes a bypass valve 182 that is disposed along the bypass line 142 and configured to regulate flow characteristics (e.g., flow rate, pressure) of the flash gas 134 through the bypass line 142. For example, in some embodiments, a pressure differential between the first leg 156 of the offset impact junction 150 and the outlet header 126 of the evaporator 106 may bias refrigerant flow from the first leg 156 to the outlet header 126. As such, the bypass valve 182 may be modulated (e.g., in accordance with instructions received from a controller) between a closed position and one or more open positions to regulate flow of the flash gas 134 from the first leg 156 to the outlet header 126, for example. It should be appreciated that the bypass valve 182, the expansion device 110, the compressor 116, and/or another suitable component or components of the vapor compression system 104 may be communicatively coupled to a controller (e.g., the control panel 82 of FIG. 4) that is configured to adjust operation of any one or combination of these components in accordance with designated control algorithms and/or control protocols.

In some embodiments, the first leg 156 of the offset impact junction 150 may be positioned vertically above a separator line 184, which may extend along an upper edge 186 of the evaporator 106 and/or along an upper-most tube of the plurality of tubes 128, for example. The separator line 184 may be indicative of a line defining an elevation of the upper edge 186 of the evaporator 106 and/or an elevation of the upper-most tube of the plurality of tubes 128. Positioning the first leg 156 vertically above the separator line 184 may facilitate gravity-based separation of the liquid refrigerant 136 and the flash gas 134 via the first separation assembly 154. In other embodiments, the first leg 156 may be positioned at any other suitable elevation with respect to the evaporator 106.

Figure 6:
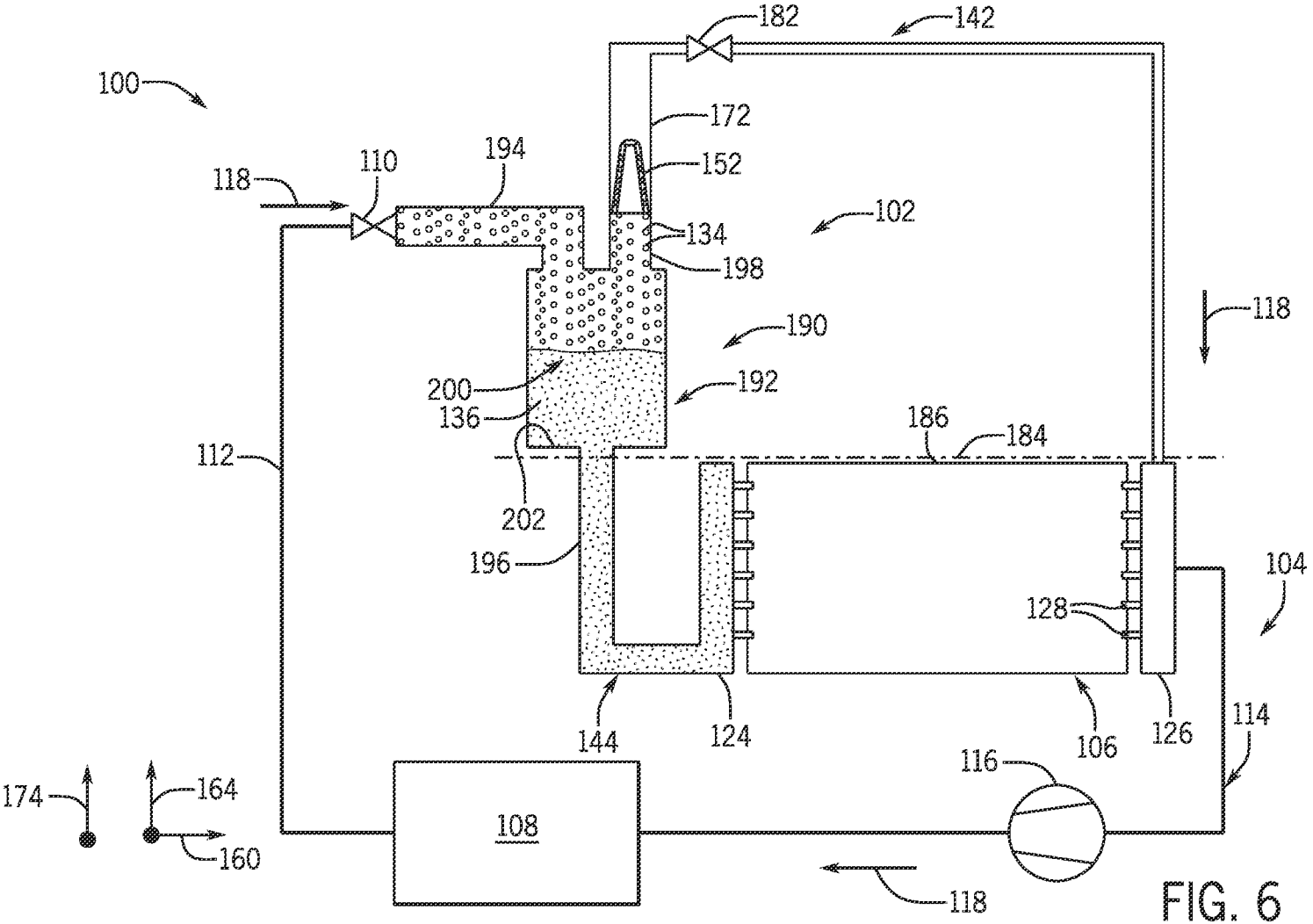
FIG. 6 is a schematic diagram of an embodiment of a portion of an HVAC system that includes a flash gas bypass system having a separation tank, in accordance with an aspect of the present disclosure.

FIG. 6 is a schematic of an embodiment of the vapor compression system 104 in which the flash gas bypass system 102 includes a second separation assembly 190, instead of the first separation assembly 154. The second separation assembly 190 may also be referred to herein as a tank separation assembly 190. The second separation assembly 190 includes a separation tank 192 that is fluidly coupled to the expansion device 110 via an inlet conduit 194 (e.g., a first leg) and configured to receive the two-phase mixture of the liquid refrigerant 136 and the flash gas 134 from the expansion device 110. The second separation assembly 190 includes a first outlet conduit 196 (e.g., a second leg) that may extend from a lower portion (e.g., with respect to gravity) of the separation tank 192 and a second outlet conduit 198 that extends from an upper portion (e.g., with respect to gravity) of the separation tank 192.

The first outlet conduit 196 may be fluidly coupled to the header conduit 144 and the second outlet conduit 198 may be fluidly coupled to and/or form a portion of the initial section 172 of the bypass line 142. Upon entering an interior 200 of the separation tank 192, the separation tank 192 enables the relatively dense liquid refrigerant 136 to accumulate near the lower portion of the separation tank 192 and beneath flash gas 134 (e.g., due to gravity), while enabling the relatively less dense flash gas 134 (e.g., with respect to the density of the liquid refrigerant 136) to accumulate vertically above the liquid refrigerant 136 (e.g., near the upper portion of the separation tank 192). The first outlet conduit 196 may drain the liquid refrigerant 136 from the lower portion of the separation tank 192 and direct the liquid refrigerant 136 toward the evaporator 106. A pressure differential between the interior 200 of the separation tank 192 and the outlet header 126 of the evaporator 106 may force the flash gas 134 accumulating near the upper portion of the separation tank 192 to flow through the filter 152 and enter a remaining portion of the bypass line 142. As such, the flash gas 134 may flow through the bypass line 142 and into the outlet header 126 in accordance with the techniques discussed above. In some embodiments, a lower surface 202 of the separation tank 192 may be positioned vertically above the separator line 184 to facilitate gravity-based separation of the liquid refrigerant 136 and the flash gas 134 in the separation tank 192.

Figure 7:
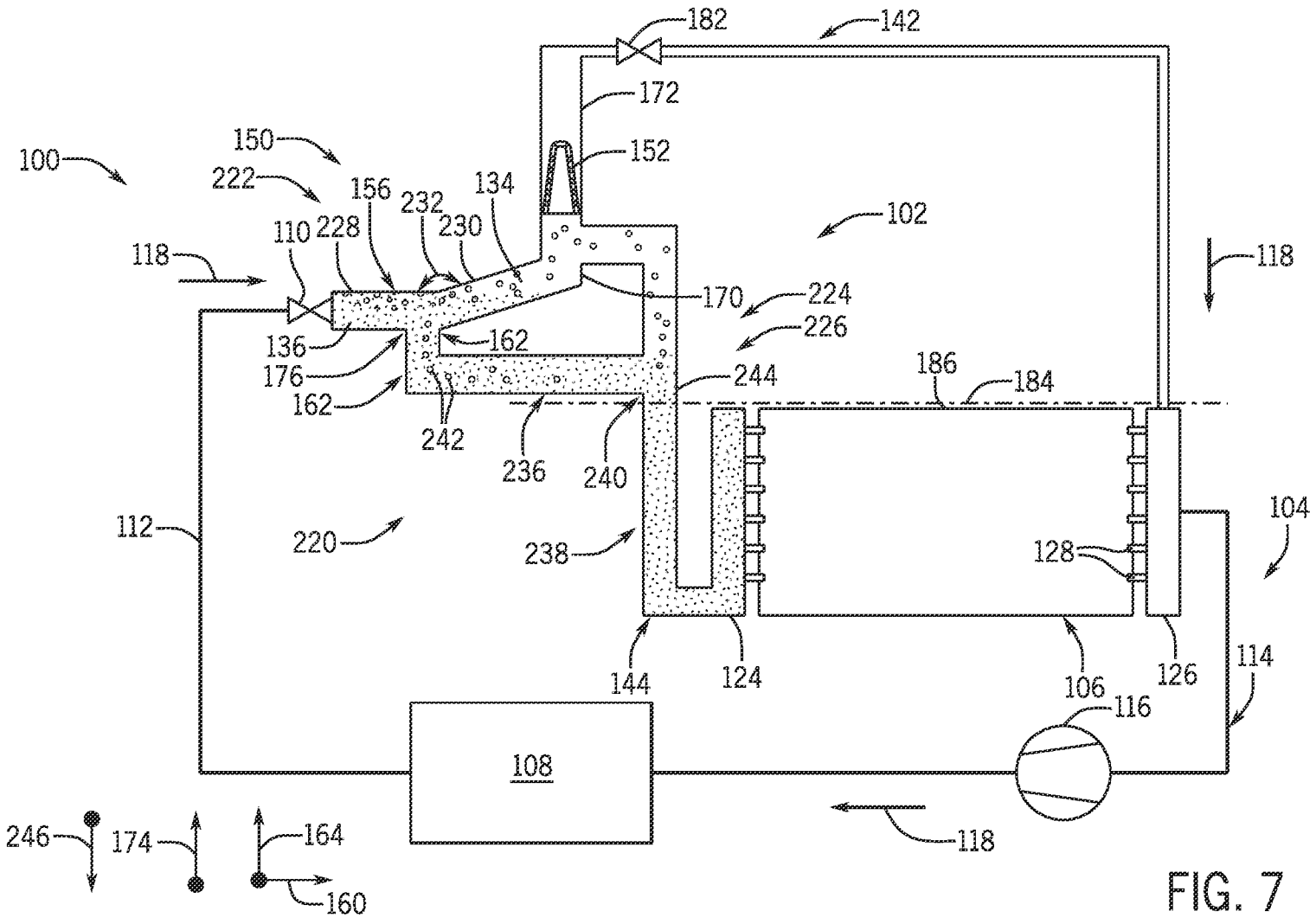
FIG. 7 is a schematic diagram of an embodiment of a portion of an HVAC system that includes a flash gas bypass system having an offset impact junction and a T-style impact junction, in accordance with an aspect of the present disclosure.

FIG. 7 is a schematic of an embodiment of the vapor compression system 104 in which the flash gas bypass system 102 includes a third separation assembly 220 having a first separation feature 222 and a second separation feature 224. The third separation assembly 220 may also be referred to herein as an angle-run separation assembly 220. The first separation feature 222 may include the offset impact junction 150 (see, e.g., FIG. 5). The second separation feature may include a T-style impact junction 226. As discussed below, the offset impact junction 150 and the T-style impact junction 226 may cooperate to facilitate separation of the flash gas 134 from the liquid refrigerant 136 in accordance with the techniques discussed herein.

In the illustrated embodiment of FIG. 7, the first leg 156 of the offset impact junction 150 includes a first leg portion 228 that is disposed upstream of the intermediate port 176 and a second leg portion 230 that is disposed downstream of the intermediate port 176. In some embodiments, the second leg portion 230 may extend upward (e.g., with respect to gravity) from the intermediate port 176 toward the initial section 172 at an angle 232. As a non-limiting example, the angle 232 may be between 92 degrees and 170 degrees. Positioning the second leg portion 230 at the angle 232 relative to the first leg portion 228 may reduce a quantity of liquid refrigerant that flows along the second leg portion 230 in the downstream direction 118 and impinges against the wall 170, as compared to embodiments of the offset impact junction 150 in which both the first leg portion 228 and the second leg portion 230 extend parallel to one another and generally along the horizontal axis 160. In accordance with aforementioned techniques, the offset impact junction 150 may divert substantially all of the flash gas 134 toward the bypass line 142, while diverting the liquid refrigerant 136 through the intermediate port 176 and into the second leg 162.

The T-style impact junction 226 may include a third leg 236 that is fluidly coupled to the second leg 162 and a fourth leg 238 that is fluidly coupled to the initial section 172 and the inlet header 124 (e.g., via the header conduit 144). In some embodiments, the third leg 236 may extend generally along the horizontal axis 160 and the fourth leg 238 may extend generally along the vertical axis 164 such that the third leg 236 and the fourth leg 238 combine to generally form a T-shape. The third leg 236 may be fluidly coupled to the fourth leg 238 via an additional intermediate port 240 (e.g., additional intermediate inlet) of the t-style impact junction 226.

In some embodiments, bubbles 242 of flash gas 134 may be suspended in the liquid refrigerant 136 flowing along the second leg 162 (e.g., in the downstream direction 118). That is, in some embodiments, the offset impact junction 150 may not fully separate all flash gas 134 from the liquid refrigerant 136, such that at least a portion of the flash gas 134 enters the second leg 162 and flows toward the third leg 236. As such, the third leg 236 may direct flow of the liquid refrigerant 136 and the bubbles 242 in the downstream direction 118 and impinge the flow of the liquid refrigerant 136 and the bubbles 242 on an additional wall 244 of the fourth leg 238. The additional wall 244 may extend along the vertical axis 164 and, thus, be oriented generally perpendicular to a direction of the refrigerant flow along the third leg 236. Differences in the relative densities of the bubbles 242 and the liquid refrigerant 136 may cause the bubbles 242, upon impinging on the additional wall 244, to flow in the upward direction 174 along the fourth leg 238, toward and into the bypass line 142, while the liquid refrigerant 136 may flow in a downward direction 246 (e.g., along a direction of gravity) along the fourth leg 238 toward and into the inlet header 124. In this way, the T-style impact junction 226 may divert residual flash gas 134 that, in some cases, may be entrapped in the liquid refrigerant 136 received from the second leg 162 in the form of the bubbles 242, toward and into the bypass line 142.

In some embodiments, the intermediate port 176 of the offset impact junction 150 may be positioned vertically above (e.g., elevated over and offset from) the additional intermediate port 240 of T-style impact junction 226. Further, the additional intermediate port 240 may be positioned vertically above (e.g., elevated over and offset from) the separator line 184, which as discussed above may be indicative of a line defining an elevation of the upper edge 186 of the evaporator 106 and/or an elevation of the upper-most tube of the plurality of tubes 128. It should be appreciated that, in certain embodiments, the first separation feature 222 or the second separation feature 224 may be replaced with the separation tank 192 (see, e.g., FIG. 6), for example.

Figure 8:
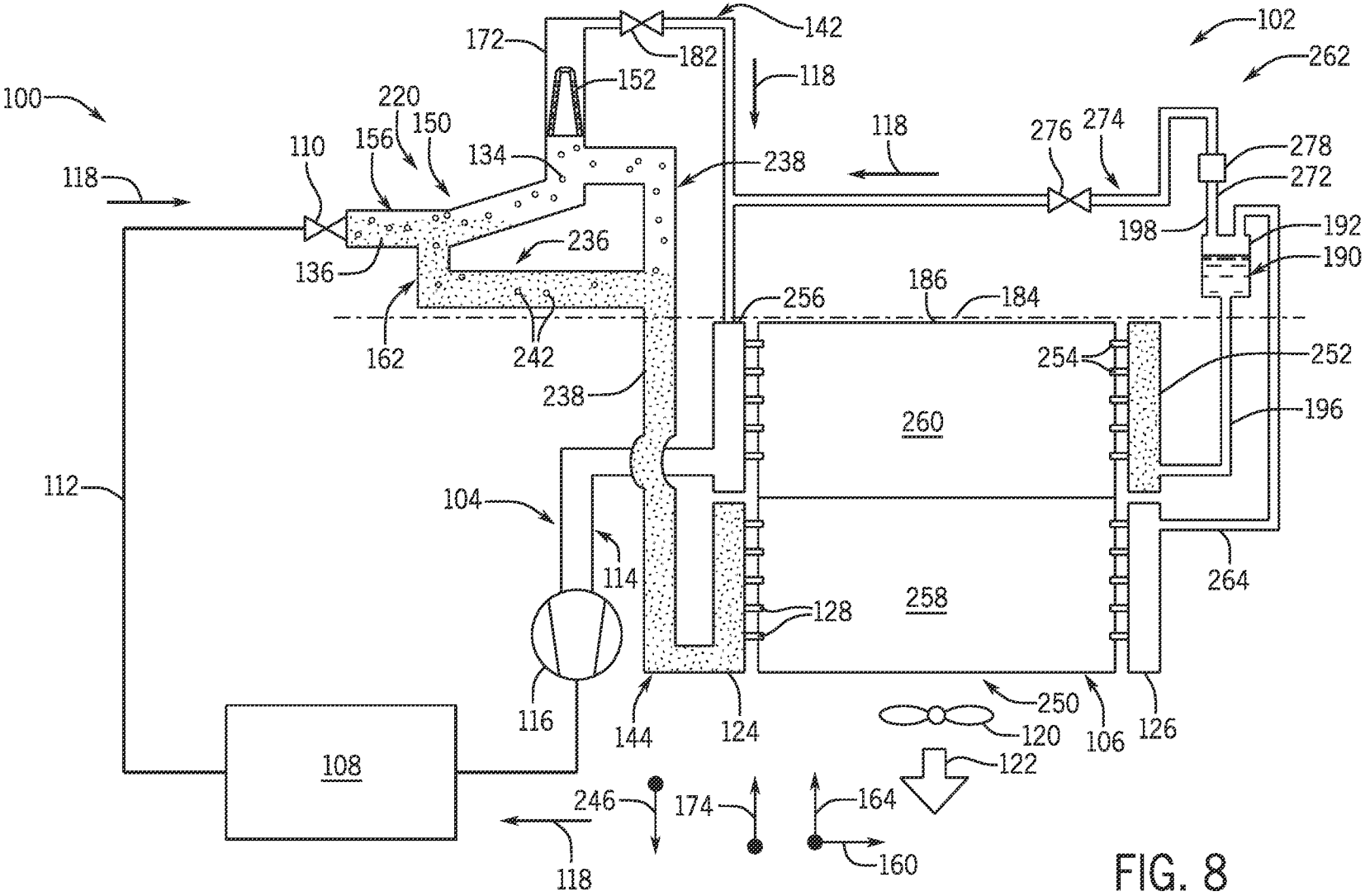
FIG. 8 is a schematic diagram of an embodiment of a portion of an HVAC system that includes a flash gas bypass system and a multi-pass heat exchanger, in accordance with an aspect of the present disclosure.

FIG. 8 is a schematic of an embodiment of the HVAC system 100 in which the evaporator 106 includes multiple passes 250. In particular, the evaporator 106 includes the inlet header 124, the plurality of tubes 128, the outlet header 126, an additional inlet header 252, an additional plurality of tubes 254, and an additional outlet header 256. The additional plurality of tubes 254 may extend between and fluidly couple the additional inlet header 252 to the additional outlet header 256. As discussed below, refrigerant received at the evaporator 106 may sequentially flow through the inlet header 124, the plurality of tubes 128, the outlet header 126, the additional inlet header 252, the additional plurality of tubes 254, and the additional outlet header 256. As such, the plurality of tubes 128 may define at least a portion of a first pass 258 (e.g., a first flow path) through the evaporator 106 and the additional plurality of tubes 254 may define at least a portion of a second pass 260 (e.g., a second flow path) through the evaporator 106.

In the illustrated embodiment, the flash gas bypass system 102 includes both the second separation assembly 190 (see, e.g., FIG. 6) and the third separation assembly 220 (see, e.g., FIG. 7). The third separation assembly 220 may be fluidly coupled along the refrigerant loop 114 between the expansion device 110 and the inlet header 124. Particularly, the fourth leg 238 may be coupled to the inlet header 124 and the bypass line 142 may be coupled to the additional outlet header 256. The second separation assembly 190 may be fluidly coupled along the refrigerant loop 114 between the outlet header 126 and the additional inlet header 252. The second separation assembly 190 and the third separation assembly 220 may collectively define a fourth separation assembly 262 of the flash gas bypass system 102. As discussed in detail below, the second separation assembly 190 facilitates removing refrigerant vapors that may discharge from the outlet header 126 of the evaporator 106 during operation of the HVAC system 100. The fourth separation assembly 262 may also be referred to herein as a distributed separation assembly 262.

For example, in accordance with the aforementioned techniques, the third separation assembly 220 may guide a flow of the flash gas 134 from the expansion device 110 to the additional outlet header 256 (e.g., via the bypass line 142), while guiding a flow of the liquid refrigerant 136 (e.g., substantially liquid refrigerant) to the inlet header 124 (e.g., via the header conduit 144). As such, the inlet header 124 may direct the liquid refrigerant 136 into and along the plurality of tubes 128. During operation of the HVAC system 100, the liquid refrigerant 136 flowing along the plurality of tubes 128 may absorb an amount of thermal energy from the supply air 122 that is sufficient to cause at least a portion of the liquid refrigerant 136 within the plurality of tubes 128 to boil (e.g., transition from a liquid phase to a gaseous phase). Accordingly, the outlet header 126 may receive a mixture of two-phase refrigerant from the plurality of tubes 128 that includes the liquid refrigerant 136 and a gaseous refrigerant. For clarity, as used herein, refrigerant that is transitioned from the liquid phase to the gaseous phase in the plurality of tubes 128 (e.g., via absorption of thermal energy from the supply air 122) will also be referred to as the flash gas 134. As such, it should be understood that the flash gas 134 may include refrigerant gas that is generated via the expansion device 110, as well as refrigerant gas that is generated within the first plurality of tubes 258, for example.

In any case, the outlet header 126 may discharge a two-phase mixture of liquid refrigerant 136 and flash gas 134 from the first pass 258 and direct the liquid refrigerant 136 and the flash gas 134 toward the separation tank 192 of the second separation assembly 190, for example (e.g., via a conduit 264). The second separation assembly 190 facilitates separation of the flash gas 134 from the liquid refrigerant in accordance with the techniques discussed above.

For example, the separation tank 192 may enable the flash gas 134 to flow through the second outlet conduit 198 and into an additional initial section 272 of an additional bypass line 274. The additional bypass line 274 may be coupled to the bypass line 142 and/or to another suitable section of the refrigerant loop 114 (e.g., to the outlet header 126, to the compressor 116). A pressure differential between the additional outlet header 256 and the interior 200 of the separation tank 192 may bias flow of the flash gas 134 from the separation tank 192, into the additional bypass line 274, and toward the additional outlet header 256, for example. An additional bypass valve 276 (e.g., the bypass valve 182) may be disposed along the additional bypass line 274 and operated in accordance with the aforementioned techniques (e.g., via control signals received from a controller) to regulate flow of the flash gas 134 along the additional bypass line 274 and toward the additional outlet header 256. In this manner, the second separation assembly 190 may enable flash gas 134 received from the outlet header 126 to bypass the second pass 260 of the evaporator 106 and flow toward the compressor 116 without flowing through the second pass 260.

Similar to the initial section 172, the additional initial section 272 may extend from the second outlet conduit 198 in the upward direction 174 and may be sized such that gravity substantially blocks liquid refrigerant droplets from being cast along the additional initial section 272 (e.g., in the upward direction 174) and into a remainder of the additional bypass line 274. In some embodiments, an additional filter 278 (e.g., the filter 152) may be disposed within and extend along a portion of the additional initial section 272, as shown in the illustrated embodiment of FIG. 8.

The first outlet conduit 196 of the separation tank 192 may drain the liquid refrigerant 136 from the lower portion of the separation tank 192 and direct the liquid refrigerant 136 into the additional inlet header 252. The additional inlet header 252 may thus receive a flow of substantially liquid refrigerant from the separation tank 192 that is substantially devoid of the flash gas 134. In this way, the second separation assembly 190 may ensure that the refrigerant received at the additional inlet header 252 is in the substantially liquid state. The additional inlet header 252 may direct the liquid refrigerant into and through the additional plurality of tubes 254, such that the liquid refrigerant 136 may flow through the second pass 260 of the evaporator 106 and discharge into the additional outlet header 256.

It should be appreciated that, in other embodiments, the second separation assembly 190 and/or the third separation assembly 220 may be replaced with any other suitable separation feature or combination of separation features discussed herein. As such, it should be understood that the fourth separation assembly 262 may be indicative of a separation assembly that includes any one or combination of separation features that are fluidly coupled between the expansion device 110 and the inlet header 124, as well as any one or combination of separation features that are fluidly coupled between the outlet header 126 and the additional inlet header 252. As a non-limiting example, the fourth separation assembly 262 may include the offset impact junction 150, the T-style impact junction 226, the separation tank 192, or a combination thereof, that is disposed between the expansion device 110 and the inlet header 124, and may include the offset impact junction 150, the T-style impact junction 226, the separation tank 192, or a combination thereof, that is disposed between the outlet header 126 and the additional inlet header 252.

Figure 9:
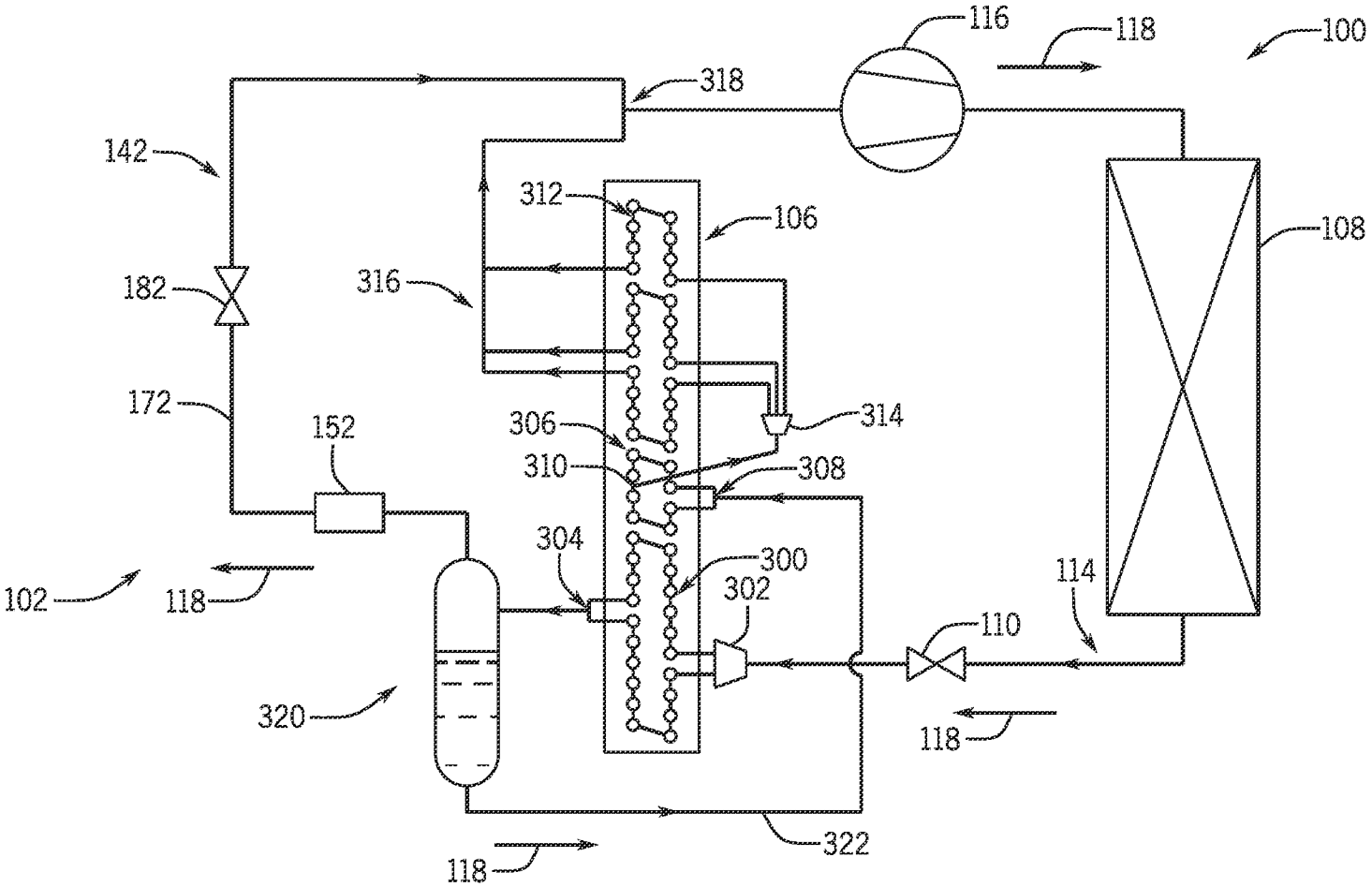
FIG. 9 is a schematic diagram of an embodiment of a portion of an HVAC system that includes a flash gas bypass system and a round-tube plate finned (RTPF) heat exchanger, in accordance with an aspect of the present disclosure.

FIG. 9 is a schematic of an embodiment of the HVAC system 100 in which the evaporator 106 is a round tube plate fin (RTPF) heat exchanger. In the illustrated embodiment, the evaporator 106 includes a first plurality of tubes 300 that extend between a first distributor 302 and a first collector 304, a second plurality of tubes 306 that extend between a manifold 308 (e.g., a header, such as the inlet header 124) and a second collector 310, and a third plurality of tubes 312 that extend between a second distributor 314 and a third collector 316. As discussed below, the first, second, and third plurality of tubes 300, 306, and 312 may sequentially define a first, second, and third pass (e.g., refrigerant flow path) through the evaporator 106. The third collector 316 and the bypass line 142 may be fluidly coupled to the compressor 116 at a junction 318.

In some embodiments, the expansion device 110 may be fluidly coupled to first plurality of tubes 300 via the first distributor 302 and configured to supply the two-phase mixture of liquid refrigerant 136 and flash gas 134 to the first distributor 302. The first distributor 302 may distribute the mixture of two-phase refrigerant received from the expansion device 110 into the first plurality of tubes 300, such that the two-phase refrigerant may absorb thermal energy from an air flow direct across the evaporator 106, for example. The first distributor 302 may uniformly distribute any flash gas 134 that may be received from the expansion device 110 between the first plurality of tubes 300. In this way, an overall impact of the flash gas 134 on the heat exchange efficiency of individual tubes of the first plurality of tubes 300 may be substantially negligible.

The first collector 304 may receive the two-phase refrigerant from the first plurality of tubes 300 and direct the two-phase refrigerant to a fifth separation assembly 320. The fifth separation assembly 320 may also be referred to herein as an RTPF separation assembly 320. The fifth separation assembly 320 may include some of or all of the components of the first separation assembly 154 (see, e.g., FIG. 5), the second separation assembly 190 (see, e.g., FIG. 6), and/or the third separation assembly 220 (see, e.g., FIG. 7), and may facilitate separation of the flash gas 134 from the liquid refrigerant 136 in accordance with the aforementioned techniques. Specifically, the fifth separation assembly 320 may direct the flash gas 134 received from the first collector 304 through the filter 152, the bypass valve 182, and the bypass line 142, such that the flash gas 134 may flow toward the compressor 116 without flowing through a remainder of the evaporator 106. The fifth separation assembly 320 may guide the liquid refrigerant 136 to the manifold 308 via a conduit 322. As such, the manifold 308 may direct the liquid refrigerant 136 into the second plurality of tubes 306 and enable the liquid refrigerant 136 to circulate through a remainder of the evaporator 106 and flow toward the compressor 116.

It should be appreciated that, because the fifth separation assembly 320 may direct substantially liquid refrigerant toward the second plurality of tubes 306, a distributor (e.g., the first distributor 302, the second distributor 314) may not be fluidly coupled between the fifth separation assembly 320 and the second plurality of tubes 306. Further, in embodiments where a separation assembly is fluidly coupled between the expansion device 110 and the first plurality of tubes 300, the first distributor 302 may be omitted and replaced within a manifold (e.g., a header, such as the inlet header 124). Moreover, in embodiments where a separation assembly is fluidly coupled between the second collector 310 and the third plurality of tubes 312, the second distributor 314 may be omitted and replaced within a manifold (e.g., a header, such as the inlet header 124).

In some embodiments, the HVAC system 100 may not include a separation assembly fluidly coupled between the expansion device 110 and the first distributor 302 and/or between the second collector 310 and the second distributor 314. However, in other embodiments, the HVAC system 100 may include a separation assembly fluidly coupled between the expansion device 110 and the first distributor 302 and/or between the second collector 310 and the second distributor 314. In some embodiments, the respective separation assembly that may be positioned between the expansion device 110 and the first distributor 302 may direct substantially all flash gas 134 discharging from the expansion device 110 into the bypass line 142, prior to the flash gas 134 flowing through the evaporator 106. Similarly, the respective separation assembly that may be positioned between the second collector 310 and the second distributor 314 may direct substantially all flash gas 134 discharging from the second collector 310 into the bypass line 142, prior to the flash gas 134 flowing through a remainder of the evaporator 106.

Figure 10:
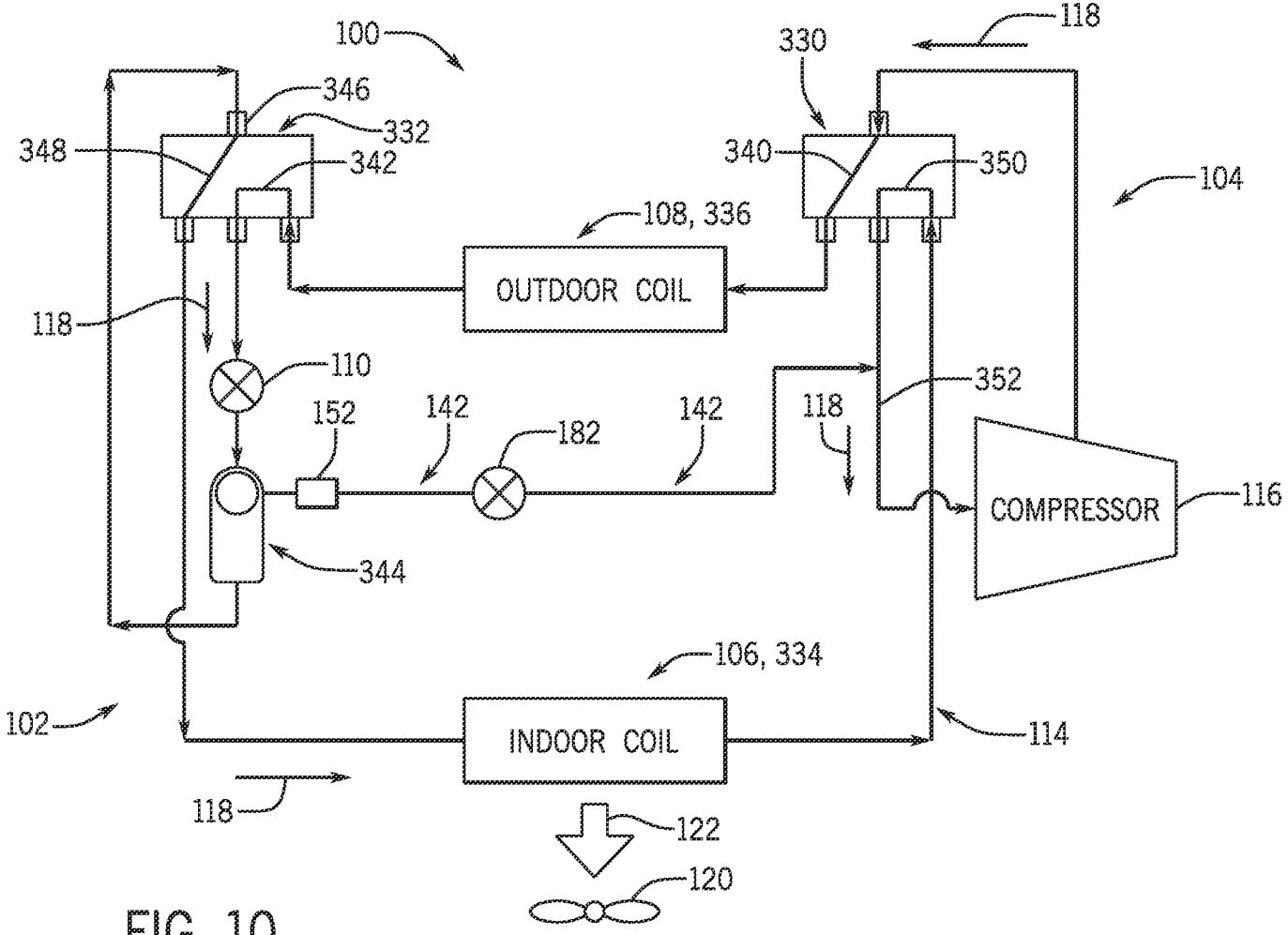
FIG. 10 is a schematic diagram of an embodiment of a heat pump having a flash gas bypass system, in accordance with an aspect of the present disclosure.

FIG. 10 is a schematic of an embodiment of the HVAC system 100 in which the vapor compression system 104 includes a first reversing valve 330 and second reversing valve 332 that are fluidly coupled to the refrigerant loop 114 and configured to regulate flow of refrigerant through the refrigerant loop 114. As discussed below, the evaporator 106, also referred to herein as an indoor coil 334, may operate as an evaporator or a condenser based on an operational mode (e.g., cooling mode, heating mode) of the HVAC system 100. Indeed, the first and second reversing valves 330, 332 enable the HVAC system 100 to operate in a cooling mode, in which the indoor coil 334 is configured to cool the supply air 122, and a heating mode, in which the indoor coil 334 is configured to heat the supply air 122. Further, the condenser 108, also referred to herein as an outdoor coil 336, may operate as a condenser or an evaporator based on whether the HVAC system 100 is operating in the cooling mode or the heating mode, respectively. In the illustrated embodiment of FIG. 10, the HVAC system 100 is in the cooling mode.

In the cooling mode of the HVAC system 100, a first valve passage 340 of the first reversing valve 330 receives a flow of refrigerant (e.g., heated refrigerant) from the compressor 116 and directs the refrigerant in the downstream direction 118 to the outdoor coil 336. The outdoor coil 336 discharges the refrigerant and directs the refrigerant to a first valve passage 342 of the second reversing valve 332. The second reversing valve 332 directs the refrigerant received from the outdoor coil 336 through the expansion device 110 (e.g., in the downstream direction 118) and into a separation assembly 344. Accordingly, the separation assembly 344 may divert flash gas 134 discharging from the expansion device 110 to the bypass line 142, while diverting the liquid refrigerant 136 back toward the second reversing valve 332. It should be understood that the separation assembly 344 may be indicative of a separation assembly that includes any one or combination of the aforementioned separation features that may be fluidly coupled between the expansion device 110 and the second reversing valve 332. As a non-limiting example, the separation assembly 344 may include the offset impact junction 150, the T-style impact junction 226, the separation tank 192, or a combination thereof, that is fluidly coupled between the expansion device 110 and an inlet 346 of the second reversing valve 332.

The separation assembly 344 may guide liquid refrigerant toward a second valve passage 348 of the second reversing valve 332, which is fluidly coupled to the indoor coil 334 and configured to direct the liquid refrigerant toward the indoor coil 334. As such, the refrigerant flowing through the indoor coil 334 may absorb thermal energy from the supply air 122 such that the supply air 122 may discharge from the indoor coil 334 as the conditioned air (e.g., cooled air). A second valve passage 350 of the first reversing valve 330 may receive the refrigerant discharging from the indoor coil 334 and direct the refrigerant back toward the compressor 116 via a conduit 352. As shown in the illustrated embodiment, the bypass line 142 may be fluidly coupled to the conduit 352 and, thus, enable flash gas 134 to flow from the expansion device 110 back into the compressor 116 without flowing through the indoor coil 334.

Figure 11:
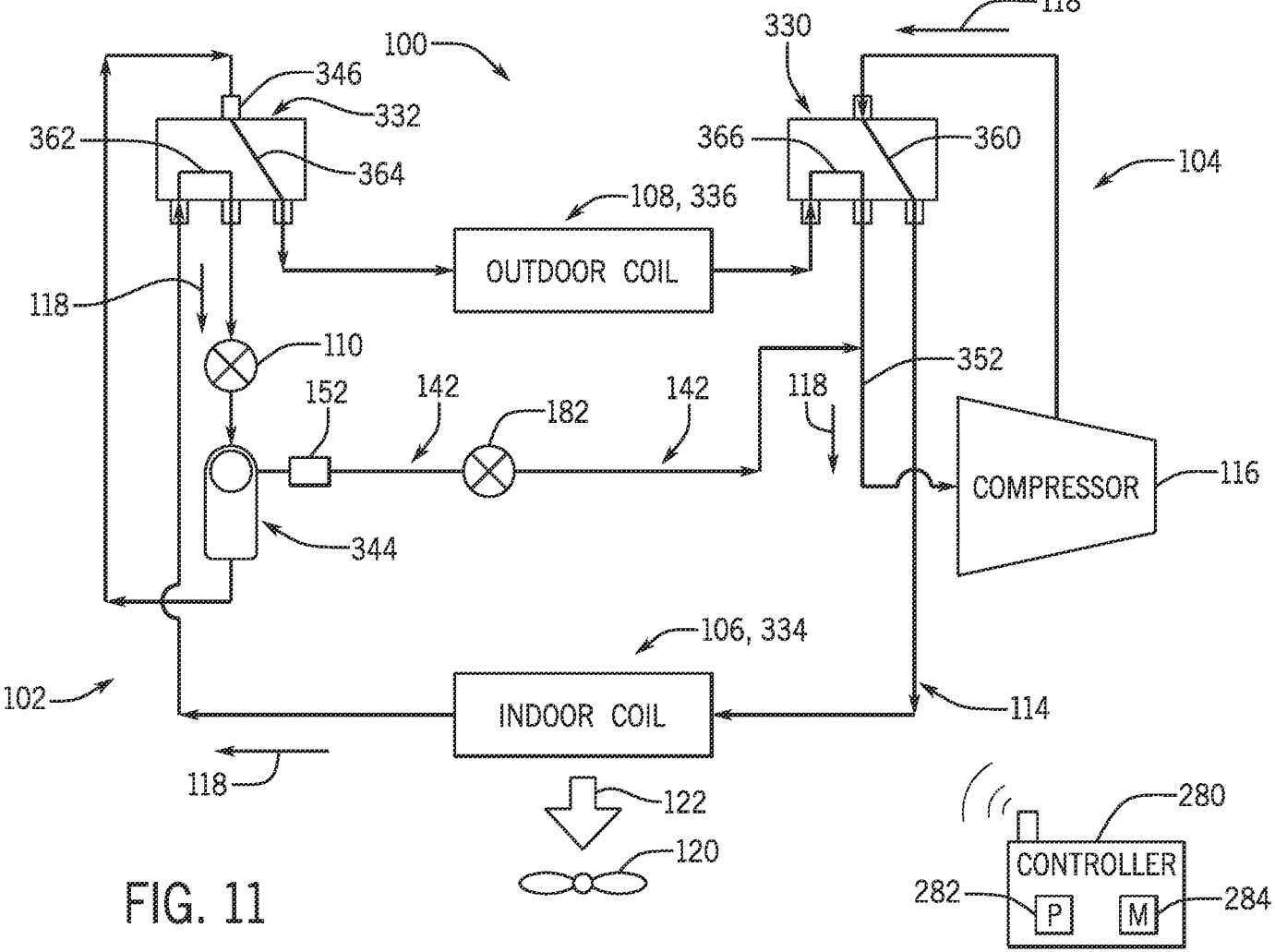
FIG. 11 is a schematic diagram of an embodiment of a heat pump having a flash gas bypass system, in accordance with an aspect of the present disclosure.

FIG. 11 is a schematic of an embodiment of the HVAC system 100 in the heating mode. In the heating mode of the HVAC system 100, a third valve passage 360 of the first reversing valve 330 receives a flow of refrigerant (e.g., heated refrigerant) from the compressor 116 and directs the refrigerant in the downstream direction 118 to the indoor coil 334. As such, the supply air 122 may absorb thermal energy from the refrigerant in the indoor coil 334 and discharge from the indoor coil 334 as the conditioned air (e.g., heated air). The indoor coil 334 discharges the refrigerant and directs the refrigerant to a third valve passage 362 of the second reversing valve 332. The second reversing valve 332 directs the refrigerant received from the indoor coil 334 through the expansion device 110 (e.g., in the downstream direction 118) and into the separation assembly 344. Accordingly, the separation assembly 344 may divert flash gas 134 discharging from the expansion device 110 to the bypass line 142, while diverting the liquid refrigerant 136 back toward the second reversing valve 332. Particularly, the separation assembly 344 may guide the liquid refrigerant toward a fourth valve passage 364 of the second reversing valve 332, which is fluidly coupled to the outdoor coil 336 and configured to direct the liquid refrigerant toward the outdoor coil 336. A fourth valve passage 366 of the first reversing valve 330 may receive the refrigerant discharging from the outdoor coil 336 and direct the refrigerant back toward the compressor 116 via the conduit 352. As such, the bypass line 142 enables the flash gas 134 to flow from the expansion device 110 back into the compressor 116 without flowing through the outdoor coil 336.

The following discussion continues with concurrent reference to FIGS. 10 and 11. It should be appreciated that the first and second reversing valves 330, 332 enable the compressor 116 to force refrigerant in the downstream direction 118 through the expansion device 110 and into the separation assembly 344 irrespectively of whether the HVAC system 100 is operating in the cooling mode or the heating mode. That is, the first and second reversing valves 330, 332 may cooperate to guide refrigerant flow through the expansion device 110 and into the separation assembly 344 in the downstream direction 118 while the indoor coil 334 is operating to cool the supply air 122 (e.g., in the cooling mode of the HVAC system 100) and while the indoor coil 334 is operating to heat the supply air 122 (e.g., in the heating mode of the HVAC system 100). Advantageously, by directing the refrigerant through the expansion device 110 in the same direction (e.g., the downstream direction 118) irrespectively of whether the HVAC system 100 is operating in the cooling mode or the heating mode, a single, unidirectional expansion device (e.g., the expansion device 110) may be adequate to enable operation of the HVAC system 100 in both the cooling or heating modes. Further, by directing the refrigerant into and through the separation assembly 344 in the same direction (e.g., the downstream direction 118) irrespectively of whether the HVAC system 100 is operating in the cooling mode or the heating mode, a single bypass line 142, bypass valve 182, and filter 152 may be adequate to enable the flash gas 134 to selectively bypass the indoor coil 334 or the outdoor coil 336 depending on whether the HVAC system 100 is operating in the cooling mode or the heating mode. In this manner, a quantity of components included in the vapor compression system 104 may be reduced as compared to, for example, embodiments of the vapor compression system 104 that utilize multiple expansion valves and/or a bi-direction expansion valve to enable effective operation of the vapor compression system 104 as a heat pump.

In the illustrated embodiment of FIG. 11, the HVAC system 100 includes a controller 280 (e.g., the control panel 82, a controller of the flash gas bypass system 102) that may be communicatively coupled to the first reversing valve 330, the second reversing valve 332, the compressor 116, the expansion device 110, and/or another suitable component or components of the HVAC system 100 to facilitate control of the HVAC system 100 and the flash gas bypass system 102 in accordance with the techniques discussed herein. For example, the controller 280 includes a processor 282, such as a microprocessor, which may execute software for controlling the components of the HVAC system 100 and/or the components of the reheat control system flash gas bypass system 102. The processor 282 may include multiple microprocessors, one or more "general-purpose" microprocessors, one or more special-purpose microprocessors, and/or one or more application specific integrated circuits (ASICS), or some combination thereof. For example, the processor 282 may include one or more reduced instruction set (RISC) processors.

The controller 280 may also include a memory device 284 that may store information such as instructions, control software, look up tables, configuration data, etc. The memory device 284 may include a volatile memory, such as random access memory (RAM), and/or a nonvolatile memory, such as read-only memory (ROM). The memory device 284 may store a variety of information and may be used for various purposes. For example, the memory device 284 may store processor-executable instructions including firmware or software for the processor 282 to execute, such as instructions for controlling components of the HVAC system 100 and/or the flash gas bypass system 102. In some embodiments, the memory device 284 is a tangible, non-transitory, machine-readable-medium that may store machine-readable instructions for the processor 282 to execute. The memory device 284 may include ROM, flash memory, a hard drive, or any other suitable optical, magnetic, or solid-state storage medium, or a combination thereof. The memory device 284 may store data, instructions, and any other suitable data.

As set forth above, embodiments of the present disclosure may provide one or more technical effects useful for inhibiting or substantially mitigating flow of flash gas from an expansion device into an evaporator. In particular, embodiments of the flash gas bypass system disclosed herein are configured to direct or otherwise divert liquid refrigerant discharging from the expansion device into the evaporator while directing or otherwise diverting the flash gas into a bypass line. In this way, the flash gas bypass system ensures that substantially all flash gas that may be generated via refrigerant flow across the expansion device bypasses the evaporator (e.g., does not flow through the evaporator) and that any refrigerant received by the evaporator (e.g., from the expansion device) is in a substantially liquid state. It should be understood that the technical effects and technical problems in the specification are examples and are not limiting. Indeed, it should be noted that the embodiments described in the specification may have other technical effects and can solve other technical problems.

While only certain features and embodiments have been illustrated and described, many modifications and changes may occur to those skilled in the art, such as variations in sizes, dimensions, structures, shapes and proportions of the various elements, values of parameters, such as temperatures and pressures, mounting arrangements, use of materials, colors, orientations, and so forth, without materially departing from the novel teachings and advantages of the subject matter recited in the claims. The order or sequence of any process or method steps may be varied or re-sequenced according to alternative embodiments. It is, therefore, to be understood that the appended claims are intended to cover all such modifications and changes as fall within the true spirit of the disclosure. Furthermore, in an effort to provide a concise description of the exemplary embodiments, all features of an actual implementation may not have been described, such as those unrelated to the presently contemplated best mode, or those unrelated to enablement. It should be appreciated that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. § 112(f).

The invention claimed is:

1. A flash gas bypass system for a vapor compression system, comprising:

a separation assembly comprising an inlet configured to receive a refrigerant flow from an expansion valve;

a bypass conduit coupled to a first port of the separation assembly and configured to receive a first portion of the refrigerant flow via the first port, wherein the first portion of the refrigerant flow comprises flash gas;

a second port of the separation assembly coupled to an outlet conduit in fluid communication with an evaporator of the vapor compression system, wherein the outlet conduit is configured to receive a second portion of the refrigerant flow via the second port and direct the second portion of the refrigerant flow toward the evaporator, wherein the second portion of the refrigerant flow comprises liquid refrigerant;

a first leg of the separation assembly extending from the inlet to an impact wall of the separation assembly;

a second leg of the separation assembly extending from the second port and cross-wise to the first leg, wherein the second port is positioned between the inlet and the impact wall; and a filter disposed in an initial section of the bypass conduit and configured to redirect droplets captured by the filter from the first portion of the refrigerant flow into the second portion of the refrigerant flow.

2. The flash gas bypass system of claim 1, wherein the first port is positioned vertically above the second port with respect to gravity, and the initial section extends from the first port in an upward direction with respect to gravity.

3. The flash gas bypass system of claim 2, wherein the impact wall defines at least a portion of the first port, and the first leg comprises a first leg portion and a second leg portion, wherein the first leg portion extends from the inlet to the second port, the second leg portion extends from the second port to the impact wall, and the first leg portion and the second leg portion are configured to direct at least a portion of the refrigerant flow to impinge onto the impact wall.

4. The flash gas bypass system of claim 3, wherein the first leg portion extends at an oblique angle relative to the second leg portion.

5. The flash gas bypass system of claim 1, wherein the separation assembly is a first separation assembly, and the flash gas bypass system further comprises:

a second separation assembly configured to be fluidly coupled between the first separation assembly and the evaporator, wherein the second separation assembly comprises:

a third leg extending from and cross-wise to the second leg; and a fourth leg extending from and cross-wise to the third leg, wherein the fourth leg is configured to receive the second portion of the refrigerant flow from the second leg and impinge the second portion of the refrigerant flow onto an additional impact wall of the fourth leg.

6. The flash gas bypass system of claim 5, wherein the fourth leg comprises a third port coupled to the initial section of the bypass conduit and a fourth port in fluid communication with the evaporator, wherein the third port is positioned along the initial section at a location upstream of the filter with respect to a flow direction of the first portion of the refrigerant flow through the filter.

7. The flash gas bypass system of claim 1, wherein at least a portion of the filter comprises a conical cross-sectional geometry.

8. The flash gas bypass system of claim 1, comprising:

the evaporator, wherein the evaporator comprises a first pass and a second pass; and an additional separation assembly fluidly coupled between the first pass and the second pass, wherein the first pass is configured to receive the second portion of the refrigerant flow, and wherein the additional separation assembly is configured to direct a first subset of the second portion of the refrigerant flow from the first pass into the second pass and to block entry of a second subset of the second portion of the refrigerant flow from the first pass into the second pass, wherein the first subset of the second portion comprises liquid refrigerant and the second subset of the second portion comprises additional flash gas.

9. The flash gas bypass system of claim 8, wherein the additional separation assembly is configured to direct the additional flash gas to the bypass conduit.

10. The flash gas bypass system of claim 1, comprising the evaporator, wherein the evaporator is an indoor coil, and wherein the flash gas bypass system comprises:

a pair of reversing valves configured to direct the refrigerant flow through the expansion valve and the separation assembly in a downstream direction while the vapor compression system operates in a cooling mode and a heating mode, to direct the refrigerant flow through indoor coil in the downstream direction while the vapor compression system operates in the cooling mode, and to direct the refrigerant flow through the indoor coil in an upstream direction, opposite the downstream direction, while the vapor compression system operates in the heating mode.

11. The flash gas bypass system of claim 1, wherein the bypass conduit is configured to direct the first portion of the refrigerant flow into an outlet header of the evaporator.

12. A heating, ventilating, and air conditioning (HVAC) system, comprising:

a refrigerant loop comprising a heat exchanger;

a separation assembly fluidly coupled to the heat exchanger and configured to receive a flow of two-phase refrigerant from an expansion valve, wherein the two-phase refrigerant comprises liquid refrigerant and gaseous refrigerant, and wherein the separation assembly comprises:

a first port coupled to a bypass conduit defining a flow path along the refrigerant loop that is independent of the heat exchanger;

a filter configured to enable flow of the gaseous refrigerant into the bypass conduit and block flow of the liquid refrigerant into the bypass conduit; and a second port configured to receive the liquid refrigerant and to direct flow of the liquid refrigerant into the heat exchanger; and a set of reversing valves coupled to the refrigerant loop, wherein the set of reversing valves is configured to guide flow of the two-phase refrigerant through the expansion valve and into the separation assembly in a downstream direction while the HVAC system operates in a cooling mode to cool a flow of supply air via the heat exchanger, and to guide flow of the two-phase refrigerant through the expansion valve and into the separation assembly in the downstream direction while the HVAC system operates in a heating mode to heat the flow of supply air via the heat exchanger.

13. The HVAC system of claim 12, wherein the filter comprises a perforated mesh configured to impede the liquid refrigerant from entering the bypass conduit.

14. The HVAC system of claim 12, wherein the separation assembly comprises an offset impact junction.

15. The HVAC system of claim 12, wherein the separation assembly is positioned vertically above an upper edge of the heat exchanger or an upper-most heat exchanger tube of the heat exchanger.

16. The HVAC system of claim 12, wherein the heat exchanger is a microchannel heat exchanger.

17. A heating, ventilating, and air conditioning (HVAC) system, comprising:

an evaporator comprising one or more first tubes defining a first pass for a refrigerant flow through the evaporator and one or more second tubes defining a second pass for the refrigerant flow through the evaporator; and a separation assembly fluidly coupled between the first pass and the second pass and configured to receive the refrigerant flow from the first pass, wherein the separation assembly comprises:

a first port configured to fluidly couple to a bypass conduit;

a filter configured to enable flow of a first portion of the refrigerant flow through the first port and to block flow of a second portion of the refrigerant flow, wherein the first portion comprises flash gas; and a second port coupled to the second pass and configured to direct the second portion of the refrigerant flow into the second pass, wherein the second portion comprises liquid refrigerant.

18. The HVAC system of claim 17, wherein the evaporator is a round tube plate finned (RTPF) evaporator, and wherein the HVAC system does not include a distributor fluidly coupled between the separation assembly and the second pass.

19. The HVAC system of claim 17, comprising an additional separation assembly fluidly coupled between an expansion valve and the first pass of the evaporator.

* * * * *